US009347258B2

(12) United States Patent
Dwarka

(10) Patent No.: US 9,347,258 B2
(45) Date of Patent: May 24, 2016

(54) RETRACTABLE CURTAIN PANEL WITH TRACK GUIDE

(76) Inventor: Rajiva A. Dwarka, Boston, MA (US)

( * ) Notice: Subject to any disclaimer, the term of this patent is extended or adjusted under 35 U.S.C. 154(b) by 0 days.

(21) Appl. No.: 13/594,091

(22) Filed: Aug. 24, 2012

(65) Prior Publication Data

US 2013/0048229 A1 Feb. 28, 2013

Related U.S. Application Data

(63) Continuation-in-part of application No. 13/469,496, filed on May 11, 2012.

(60) Provisional application No. 61/527,765, filed on Aug. 26, 2011, provisional application No. 61/587,788, filed on Jan. 18, 2012, provisional application No. 61/484,930, filed on May 11, 2011.

(51) Int. Cl.

| | |
|---|---|
| ***E06B 9/58*** | (2006.01) |
| ***E06B 9/24*** | (2006.01) |
| ***E06B 9/26*** | (2006.01) |
| ***E06B 9/40*** | (2006.01) |
| *E06B 9/262* | (2006.01) |

(52) U.S. Cl.

CPC ... *E06B 9/24* (2013.01); *E06B 9/26* (2013.01); *E06B 9/40* (2013.01); *E06B 9/58* (2013.01); *E06B 2009/2452* (2013.01); *E06B 2009/2627* (2013.01)

(58) Field of Classification Search

CPC ..... E06B 9/24; E06B 2009/405; E06B 2009/2452; E06B 2009/2458; E06B 9/58; E06B 9/581

USPC ..... 160/241, 120, 271, 121.1, 87, 268.1, 160/270, 272, 273.1, 201, 345

See application file for complete search history.

(56) References Cited

U.S. PATENT DOCUMENTS

| | | | | | |
|---|---|---|---|---|---|
| 58,668 | A | * | 10/1866 | Morrison | 160/121.1 |
| 1,198,456 | A | | 9/1916 | Knapp | |
| 1,725,307 | A | | 8/1929 | Sembower | |
| 1,800,654 | A | | 4/1931 | Nelson | |
| 1,898,686 | A | | 2/1933 | Rice | |
| 2,280,358 | A | * | 4/1942 | Tietig | 160/120 |
| 3,292,685 | A | * | 12/1966 | Clark | 160/26 |
| 3,430,677 | A | | 3/1969 | Pierce | |
| 3,929,685 | A | | 12/1975 | Jung | |
| 4,006,770 | A | * | 2/1977 | Ferguson | 160/263 |
| 4,089,361 | A | * | 5/1978 | Zeppmeisel | 160/120 |
| 4,157,108 | A | * | 6/1979 | Donofrio | 160/263 |
| 4,237,956 | A | * | 12/1980 | Sivin et al. | 160/120 |

(Continued)

*Primary Examiner* — Katherine Mitchell

*Assistant Examiner* — Johnnie A Shablack

(74) *Attorney, Agent, or Firm* — Wolf, Greenfield & Sacks, P.C.

(57) ABSTRACT

According to some aspects, provided are curtain assemblies comprising two or more curtains selectably moveable between an open position and a closed position. Some embodiments include a track guide for at least one of the curtains having a first track and second track insert coupled to respective sides of the track guide and the curtain, wherein the curtain is moveably coupled to the first and second track inserts, and moveable along the channel of operation during transition between the open and the closed position. The curtains can be configured to define an air pocket that improved the energy efficiency of the curtain assembly (e.g., improving heat and/or noise properties). Some embodiments include a roller guide to maintain spacing between the curtains and can define a boundary of the air pocket.

30 Claims, 20 Drawing Sheets

(56) References Cited

U.S. PATENT DOCUMENTS

| | | | | |
|---|---|---|---|---|
| 4,357,978 | A | 11/1982 | Keller et al. | |
| 4,369,829 | A * | 1/1983 | Casiday | 160/120 |
| 4,467,853 | A | 8/1984 | Downey, Jr. | |
| 4,478,268 | A | 10/1984 | Palmer | |
| 4,539,238 | A * | 9/1985 | Markowitz | 428/43 |
| 4,583,517 | A * | 4/1986 | Hilton et al. | 126/502 |
| 4,610,293 | A * | 9/1986 | Weiblen | E06B 7/02 160/120 |
| 4,679,406 | A * | 7/1987 | Weiblen | 62/262 |
| 4,736,785 | A | 4/1988 | Seuster | |
| 4,776,379 | A | 10/1988 | Kraeutler | |
| 4,800,946 | A | 1/1989 | Rosenoy | |
| 4,934,437 | A | 6/1990 | Kraeutler | |
| 5,056,579 | A | 10/1991 | Krafutler | |
| 5,099,905 | A | 3/1992 | Rigter | |
| 5,141,043 | A | 8/1992 | Kraeutler | |
| 5,199,479 | A | 4/1993 | Kraeutler | |
| 5,291,932 | A | 3/1994 | Kraeutler | |
| 5,323,831 | A | 6/1994 | Manthei | |
| 5,377,738 | A | 1/1995 | Cooper | |
| 5,394,926 | A | 3/1995 | Kraeutler | |
| 5,477,902 | A | 12/1995 | Kraeutler | |
| 5,526,865 | A * | 6/1996 | Coenraets | 160/272 |
| 5,791,392 | A | 8/1998 | Fernandez Lopez | |
| 6,035,917 | A | 3/2000 | Cohen-Ravid | |
| 6,119,758 | A * | 9/2000 | Coenraets | E04H 4/101 160/273.1 |
| 6,286,579 | B1 | 9/2001 | Gottschalk | |
| 6,474,395 | B2 | 11/2002 | Weiss | |
| 6,691,761 | B1 | 2/2004 | Alkhoury et al. | |
| 6,705,378 | B1 * | 3/2004 | Smidt | 160/120 |
| 6,722,416 | B2 | 4/2004 | Varley et al. | |
| 7,093,643 | B2 * | 8/2006 | Ikle | 160/120 |
| 7,131,481 | B2 * | 11/2006 | Varley et al. | 160/273.1 |
| 7,137,429 | B2 | 11/2006 | Jelic | |
| 7,275,581 | B2 * | 10/2007 | Coenraets | 160/273.1 |
| 7,360,575 | B2 | 4/2008 | Weiss | |
| 7,389,807 | B2 * | 6/2008 | Nagare | E06B 9/13 160/268.1 |
| 7,416,014 | B2 | 8/2008 | Coenraets | |
| 7,748,431 | B2 * | 7/2010 | Jansen et al. | 160/268.1 |
| 7,841,377 | B2 * | 11/2010 | Coenraets | 160/268.1 |
| 8,025,088 | B2 * | 9/2011 | Kim | 160/120 |
| 8,113,261 | B2 | 2/2012 | Lin | |
| 8,113,265 | B2 | 2/2012 | Hardison, III et al. | |
| 8,127,821 | B2 | 3/2012 | Hsu et al. | |
| 8,156,992 | B2 | 4/2012 | Diaz et al. | |
| 8,186,411 | B2 | 5/2012 | Lin | |
| 8,186,412 | B2 | 5/2012 | Lin | |
| 8,235,086 | B2 * | 8/2012 | Smith | 160/122 |
| 8,291,960 | B2 | 10/2012 | Bowman | |
| 8,316,915 | B2 * | 11/2012 | Drifka et al. | 160/271 |
| 8,347,937 | B2 * | 1/2013 | Murphy | 160/84.04 |
| 8,408,274 | B2 | 4/2013 | Dwarka | |
| 8,434,817 | B2 * | 5/2013 | Sawada | 296/220.01 |
| 8,448,689 | B2 | 5/2013 | Roberts et al. | |
| 8,550,142 | B2 * | 10/2013 | Gaskill et al. | 160/121.1 |
| 8,607,841 | B2 * | 12/2013 | Hayashiguchi | E06B 9/581 160/273.1 |
| 8,851,146 | B2 | 10/2014 | Dwarka | |
| 2003/0127198 | A1 | 7/2003 | Court et al. | |
| 2003/0173040 | A1 | 9/2003 | Court et al. | |
| 2003/0188837 | A1 | 10/2003 | Varley et al. | |
| 2008/0035282 | A1 * | 2/2008 | Coenraets | 160/272 |
| 2008/0093037 | A1 | 4/2008 | Kraeutler | |
| 2009/0277593 | A1 * | 11/2009 | Stewart | 160/127 |
| 2009/0278703 | A1 * | 11/2009 | Iglesias Ballester | 340/825 |
| 2010/0006239 | A1 | 1/2010 | Kraeutler | |
| 2010/0269985 | A1 | 10/2010 | Hanley et al. | |
| 2010/0307697 | A1 * | 12/2010 | Perkowitz | 160/108 |
| 2011/0067820 | A1 | 3/2011 | Hsu et al. | |
| 2011/0094689 | A1 | 4/2011 | Dwarka | |
| 2011/0108214 | A1 | 5/2011 | Komatsu et al. | |
| 2011/0146918 | A1 | 6/2011 | Vestal | |
| 2011/0203742 | A1 | 8/2011 | Lin | |
| 2011/0247761 | A1 | 10/2011 | Lin | |
| 2011/0247762 | A1 | 10/2011 | Lin | |
| 2012/0043029 | A1 * | 2/2012 | Gaskill et al. | 160/121.1 |
| 2012/0222824 | A1 * | 9/2012 | Lin | 160/25 |
| 2012/0291963 | A1 * | 11/2012 | Marocco | 160/120 |
| 2013/0048229 | A1 | 2/2013 | Dwarka | |
| 2013/0068400 | A1 | 3/2013 | Dwarka | |
| 2013/0098564 | A1 * | 4/2013 | Jang | 160/120 |
| 2013/0220559 | A1 | 8/2013 | Dwarka | |
| 2013/0269883 | A1 | 10/2013 | Dwarka | |

* cited by examiner

RETRACTABLE CURTAIN PANEL WITH TRACK GUIDE

CROSS-REFERENCE TO RELATED APPLICATIONS

This application is a continuation-in-part and claims priority under 35 U.S.C. §120 to U.S. patent application Ser. No. 13/469,496 entitled "RETRACTABLE CURTAIN PANEL WITH TRACK GUIDE," filed on May 11, 2012 which claims priority under 35 U.S.C. §119(e) to U.S. Provisional Application Ser. No. 61/484,930 entitled "RETRACTABLE CURTAIN PANEL WITH TRACK GUIDE," filed May 11, 2011, this application also claims priority under 35 U.S.C. §119(e) to U.S. Provisional Application Ser. No. 61/527,765 entitled "RETRACTABLE CURTAIN PANEL WITH TRACK GUIDE," filed Aug. 26, 2011 and claims priority under 35 U.S.C. §119(e) to U.S. Provisional Application Ser. No. 61/587,788 entitled "RETRACTABLE CURTAIN PANEL WITH TRACK GUIDE," filed Jan. 18, 2012 which applications are incorporated herein by reference in their entirety.

BACKGROUND

Traditional window curtain installations are configured to provide for both functional and aesthetic purposes. In a conventional curtain, one functional goal is to reduce light impinging upon dwelling areas or other interior spaces coming from exterior windows. Other functions include providing for removal of the shading portions of the curtain to allow more light as desired. In some examples, this can be accomplished by winding a curtain around a roller operated by hand via a draw cord. An operator can raise or lower a curtain depending upon, for example, a desired amount of light. In other examples, the roller can be operated via a motor to raise and lower the curtain, covering exterior facing windows to any desired degree.

Typically, consumers select curtains based not only on the functional aspects provided, but also based on the aesthetic of the curtain. In some situations the physical layout of a space (e.g., a building home or office) dictates the shape and configuration of a given curtain. Traditional curtain designs can fail to incorporate non-traditional materials, and are often limited to conventional installation settings. Conventional settings include, for example, installation over vertically installed windows and/or sliding glass doors. Traditional curtains typically employ gravity to assist in the normal operation of the curtain. These traditional installations can fail to address operation outside of conventional parameters, and further can fail to address non-conventionally shaped openings.

SUMMARY

Accordingly there is provided a retractable curtain assembly for installation in non-conventional spaces. In one embodiment, the retractable curtain assembly is configured for operation of a curtain on a slope. The curtain can be manipulated between an open position where the curtain is recessed and the opening on which the curtain is installed is visible and a closed position wherein the curtain is extended to cover the opening. The curtain can also be manipulated to occupy various positions between the open and closed positions. A track guide coupled to a track insert can be configured to hold the curtain in place during operation, enabling transition between the closed and open position where the assembly operates on a slope. The track guide and track insert can be constructed and arranged to mate with structures on the curtain. In one example, a zipper edge on the curtain travels in a channel structure constructed on the track insert. The zipper edge is configured to hold the curtain within the track insert while allowing the curtain to move between the open and closed position. The track insert can be configured to maintain tension within the curtain allowing movement of the curtain along a sloped plane without deflection of the curtain. In some examples, the track insert can be fixed within the track guide. In other examples, the track insert can be configured to ride within a channel defined in the track guide. In some embodiments, the dimensions of the channel in the track guide can be constructed to permit some movement of the track insert within the channel defined in the track guide. Permitting movement of the track insert within the track guide can relieve tension in the curtain and assist in operation. In some settings, wind on the curtain can increase tension until the curtain binds and cannot be moved. In some examples, allowing some play in the track insert within the channel defined by the track guide prevents binding conditions.

According to one aspect, a curtain assembly is provided. The curtain assembly comprises a curtain selectably moveable between an open position and a closed position, a track guide that defines a plane of operation of the curtain as it moves between the open position and the closed position, and a track insert coupled to the track guide, wherein the curtain is moveably coupled to the track insert, wherein the track insert defines a channel of operation at which the track insert and the curtain are moveably coupled, and wherein the curtain travels along the channel of operation during transition between the open and the closed position. According to one embodiment, the curtain assembly further comprises a connection portion of the curtain constructed and arranged with an end portion having a width greater than the channel of operation and a travel portion having a width less than the width of the channel of operation at which the track insert and curtain are moveably coupled. According to one embodiment, the end portion is comprised of a plurality of teeth connected to a side of the curtain, and the plurality of teeth define the width greater than the width of the channel of operation.

According to one embodiment, the curtain assembly further comprises a bottom rail constructed and arranged to provide tension within the curtain to maintain a shape of the curtain within the plane of operation. According to one embodiment, the curtain assembly further comprises at least one stiffener element constructed and arranged to maintain a shape of the curtain within the plane of operation. According to one embodiment, the curtain is a fabric curtain. In one example, the curtain is a flat or substantially flat fabric curtain. According to one embodiment, the plane of operation is defined on a slope. According to one embodiment, the slope is greater than 10 degrees. According to one embodiment, the slope is greater than 20 degrees. According to one embodiment, the slope is greater than 30 degrees. According to one embodiment, the slope is greater than 40 degrees.

Tension on the curtain can be provided between opposed tracks and configured to insure the curtain remains disposed between the tracks over the entire length of the curtain's operation. Conventional curtains and curtain assembly fail to operate properly when installed on a sloping surface. Conventional curtains are typically configured for vertical motion alone. Angling the operation of a traditional curtain results in the curtain dragging against the installed surface, falling out of any curtain track, assuming the curtain is able to operate at all. According to one embodiment, the retractable curtain assembly can even be installed in horizontal positions in which some conventional curtain assemblies cannot function.

According to one aspect, a curtain assembly is provided. The curtain assembly comprises at least a first and second curtain selectably moveable between an open position and a closed position, a track guide having first and second opposed sides, wherein the first and second side define a plane of operation for the first curtain as it moves between the open position and the closed position, a first and second track insert coupled to the opposed sides of the track guide, wherein the first curtain is moveably coupled to the first and second track inserts, wherein the first and second track inserts each define a respective channel of operation at which the track insert and the curtain are moveably coupled, and wherein the curtain travels along the channel of operation during transition between the open and the closed position, and an air barrier defined between the at least first and second curtains configured to improve energy properties of the curtain assembly.

In one embodiment, the air barrier includes opposed side boundaries, wherein opposed regions of the opposed side boundaries are defined by the track guide and the first and second track inserts. In one embodiment, the curtain assembly further comprises a brush portion constructed and arranged to bridge a spacing between the first and second curtains, wherein the brush portion is constructed and arranged to further define a boundary of the air barrier. In one embodiment, the curtain assembly further comprises a brush portion constructed and arranged to seal a top portion of the air barrier. In one embodiment, the brush portion is constructed and arranged to traverse the width of the first and second curtains. In one embodiment, the curtain assembly further comprises a base member connecting the first and second curtains. In one embodiment, the base member is constructed and arranged to connect bottom portions of the first and second curtains. In one embodiment, the base member is constructed and arranged to define a boundary of the air bather. In one embodiment, the base member is constructed and arranged to define a bottom boundary of the air barrier. In one embodiment, the base member is constructed and arranged to traverse the width of the first and second curtains.

In one embodiment, the second curtain is constructed and arranged of a cellular fabric. In one embodiment, the first curtain has an energy value substantially less that the second curtain. In one embodiment, the curtain assembly, further comprises at least one stiffener guide constructed and arranged to strengthen the cellular fabric. In one embodiment, the curtain assembly further comprises a second track guide having a first and second side, wherein the first and second side define a plane of operation for the second curtain as it moves between the open position and the closed position. In one embodiment, the first and second sides include respective channel guides. In one embodiment, the curtain assembly further comprises at least one stiffener guide positioned within the cellular fabric, wherein the at least one stiffener guide is constructed and arranged to ride within the respective channel guides during operation of the curtain assembly. In one embodiment, the curtain assembly further comprises a first roll tube, wherein the first roll tube is configured to wind the first and second curtains around the roll tube during operation of the curtain assembly, wherein the first and second curtains are connected to the roll tube in overlapping positions.

In one embodiment, the curtain assembly further comprises a roller guide configured to maintain a spacing between the first and second curtains. In one embodiment, the roller guides define an upper border region of the air barrier. In one embodiment, the curtain assembly further comprises a bottom rail connected to at least one of the first and second curtains. In one embodiment, the bottom rail includes a length adjustment channel. In one embodiment, at least one of the first and second curtains is connected to a bar within the bottom rail, wherein the bar is constructed and arranged to travel within the adjustment channel. In one embodiment, the bar is weighted to pull excess length of a connected curtain into the adjustment channel.

In one embodiment, the curtain assembly further comprises a second track guide having a first and second side, wherein the first and second side define a plane of operation for the second curtain as it moves between the open position and the closed position, a first and second track insert coupled to opposed sides of the second track guide, wherein the second curtain is moveably coupled to the first and second track inserts, wherein the first and second track inserts each define a respective channel of operation at which the track insert and the second curtain are moveably coupled, and wherein the second curtain travels along the channel of operation during transition between the open and the closed position. In one embodiment, the curtain assembly further comprises a first connection portion of the first curtain constructed and arranged with an end portion having a width greater than a width of the channel of operation and a travel portion having a width less than the width of the channel of operation at which the track insert and the first curtain are moveably coupled.

In one embodiment, the end portion is comprised of a plurality of teeth connected to a side of the first curtain at the end portion, wherein the plurality of teeth are constructed and arranged to have a width greater than the width of the channel of operation. In one embodiment, the curtain assembly further comprises a bottom rail constructed and arranged to provide tension within the curtain to maintain a shape of the first curtain. In one embodiment, the curtain assembly further comprises at least one stiffener element constructed and arranged to maintain a shape of the first curtain. In one embodiment, the curtain is a substantially flat fabric curtain.

In one embodiment, the plane of operation is defined on a slope relative to an installed surface. In one embodiment, the plane of operation relative to an installed surface is greater than 10 degrees. In one embodiment, the plane of operation relative to an installed surface is greater than at least one of 20 degrees, 30 degrees, and 40 degrees.

In one embodiment, each of the first and second sides of the track guide are constructed and arranged to have exterior walls and interior walls, wherein the exterior and interior walls define respectively a first channel and second channel. In one embodiment, a first portion of the first track insert is positioned in the first channel defined by the exterior and interior walls. In one embodiment, a second portion of the first track insert extends between the interior walls and into the second channel. In one embodiment, the second portion of the first track insert includes a connection channel defining a respective side of the channel of operation. In one embodiment, the curtain assembly further comprises a roll tube including at least one recessed portion to accept the width of the end portion. In one embodiment, the curtain assembly further comprises at least one tension box connect to the curtain to provide operational force in the direction of the plane of operation. In one embodiment, the curtain assembly further comprises a bottom rail is constructed and arranged to moveably operate within the second channel and to provide tension within the curtain to maintain a shape of the curtain.

According to one aspect a curtain assembly is provided. The curtain assembly comprises at least a first and a second curtain selectably moveable between an open position and a closed position, a roll tube configured to wind to the first and second curtains around the roll tube during operation of the curtain assembly, wherein the first and second curtains are connected to the roll tube in overlapping positions, and a roller guide configured to maintain a spacing between the first and second curtains during operation. In one embodiment, the curtain assembly further comprises an air barrier defined between the first and second curtains configured to improve energy properties of the curtain assembly. In one embodiment, the curtain assembly further comprises at least one brush portion constructed and arranged to improve an air seal at a top portion of the air barrier. In one embodiment, at least one brush portion is constructed and arranged to traverse the width of the first and second curtains. In one embodiment, the curtain assembly further comprises a bottom rail connected to at least one of the first and second curtains. In one embodiment, the bottom rail includes a length adjustment channel. In one embodiment, at least one of the first and second curtains is connected to a bar within the bottom rail, wherein the bar is constructed and arranged to travel within the adjustment channel. In one embodiment, the bar is weighted to pull excess length of a connected curtain into the adjustment channel.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

Various aspects of at least one embodiment are discussed below with reference to the accompanying figures. Where technical features in the figures, detailed description or any claim are followed by reference signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION

Figure 1:
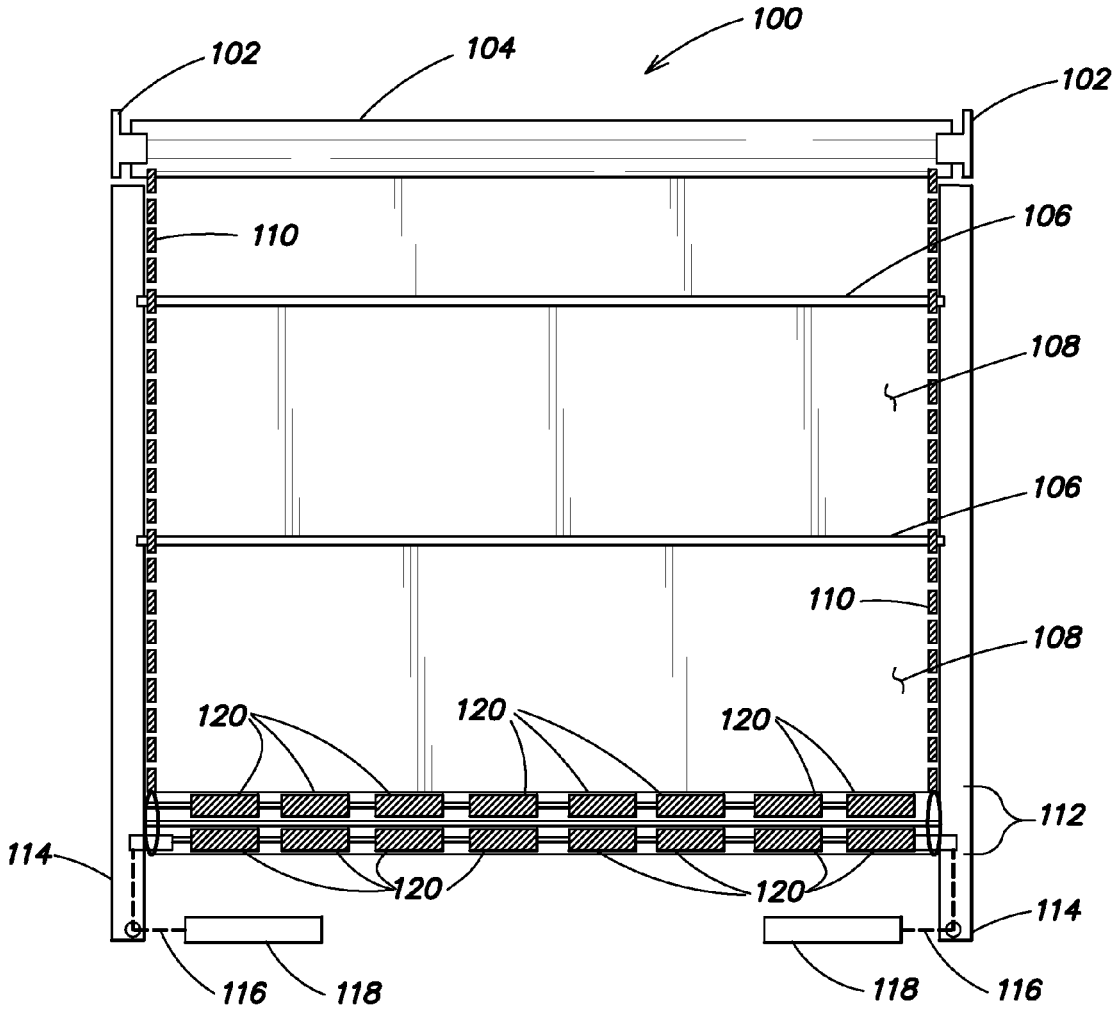
FIG. 1 illustrates an example curtain assembly according to one embodiment.

FIG. 1 illustrates one embodiment incorporating some aspects of the present disclosure. Curtain assembly 100 can be configured to operate over sloped surfaces, including windows, and/or other openings. Curtain assembly 100 includes mounting brackets 102 for installing a roll tube 104 having a curtain 108 over, for example, a window. In some examples, the curtain 108 is made of fabric. In other examples, the fabric curtain can be made of natural fibers, and in others can be constructed of artificial fibers. In some other examples, the curtain can be constructed of a blend of natural and artificial fibers. According to one embodiment, the fabric curtain is a flat sheet of fabric wound around the roll tube 104. Rotation of roll tube 104 causes curtain 108 to transition between an open (recessed) and a closed (extended) position. The rotation of roll tube 104 can be controlled via a drawn string (not shown), or in some embodiments curtain assembly 100 can include motors for rotating roll tube 104 (not shown). The curtain 108 may include fabric stiffeners 106 to provide rigidity. Fabric stiffeners 106 can be constructed of various materials, including metal bands fixed to one or more sides of the curtain. Co-pending application Ser. No. 12/911,807, entitled ARCHITECTURAL APPARATUS AND METHOD, filed on Oct. 26, 2010, incorporated by reference herein by reference in its entirety, describes examples of banding constructed about fabric curtains that provide rigidity and support for the curtains of various curtain assemblies. In some embodiments, the fabric stiffeners 106 can be omitted.

Figure 2:
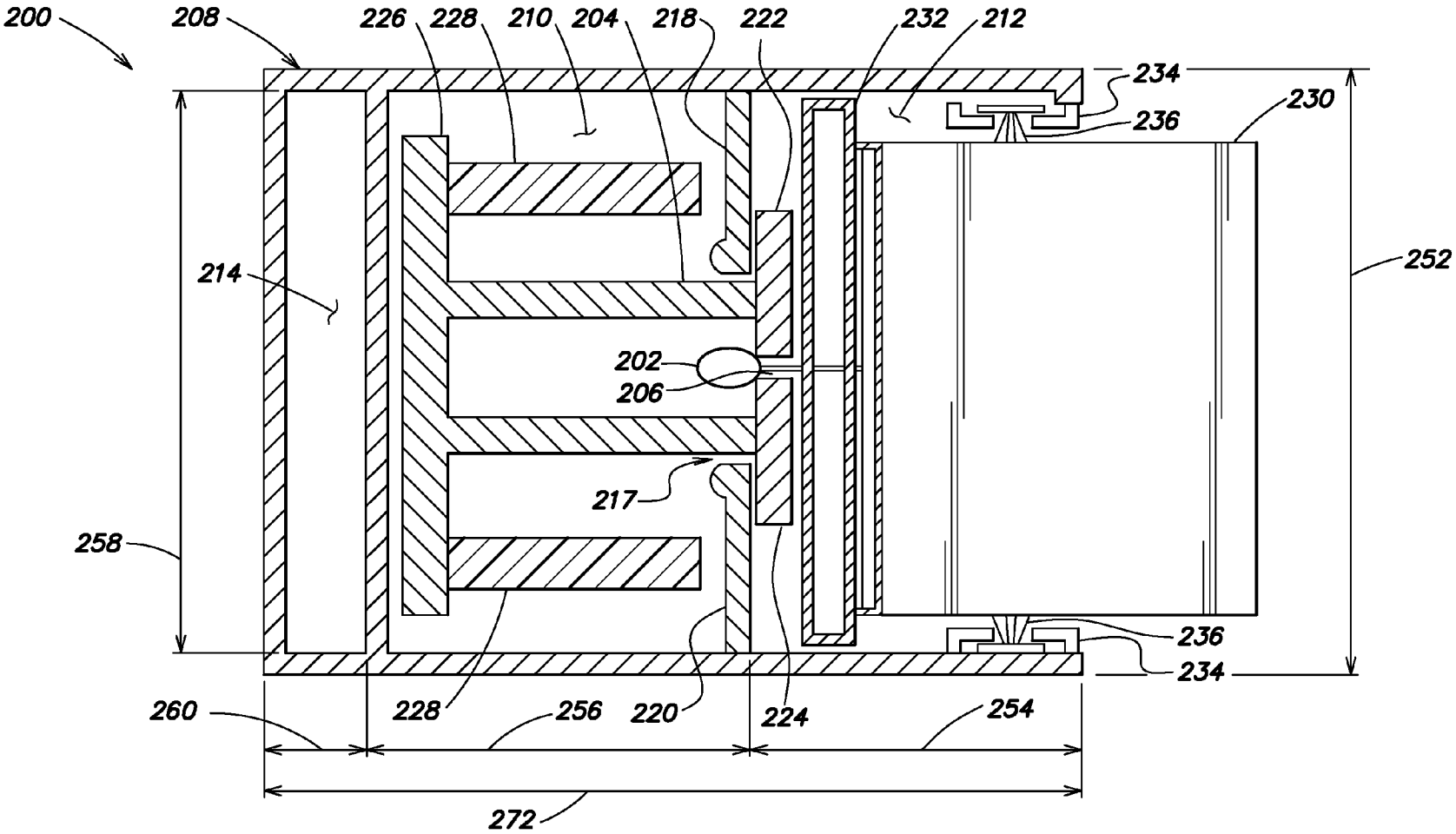
FIG. 2 illustrates an example track assembly includes a track guide, according to one embodiment.

The curtain 108 is constructed to ride within guide tracks 114 during operation. Guide tracks 114 can include track inserts (not shown in FIG. 1) configured to mate with curtain 108. In some embodiments, curtain 108 is constructed with zipper edges 110. Zipper edges 110 resemble one half of a conventional zipper structure. Zipper edge 110 includes teeth which can be constructed of various materials including metal or plastic. The teeth of zipper edge 110 ride within a channel defined by the track insert. Referring to FIG. 2, track assembly 200 illustrates an example of teeth 202 of a zipper edge, configured to mate with a track insert 204. Track insert 204 defines a channel 206 in which a portion of the curtain or a portion of a zipper edge 110 may move freely during transitions between opened and closed positions of a curtain assembly. The teeth 204 and the channel 206 are constructed and arranged to prevent the curtain from coming free of the track insert 204. The track assembly shown in FIG. 2 illustrates a cross section view of one of the track guides shown in FIG. 1 at 114. Returning to FIG. 1, zipper edges 110 can be constructed to provide rigidity in the curtain 108. In some embodiments, as curtain 108 deflects from a plane of operation defined between the track guides 114, opposing pressure will be exerted on the curtain 108 by virtue of the teeth 202 disposed in the track insert 204 on either side of the curtain 108.

According to one embodiment, curtain 108 is attached to a bottom rail 112. Bottom rail 112 is constructed and arranged to assist in the operation of the curtain assembly between an open position and a closed position. In some embodiments, bottom rail 112 can include weights at 120. The weights are configured to assist in unwinding the curtain 108 from the roll tube 104 into a closed position and to provide resistance as the curtain 108 is wound around roll tube 104 towards an open position. In some embodiments, the weights at 120 are optional. In horizontal implementations, for example, weights at 120 provide little or no assistance in operation of the curtain assembly. In some embodiments, bottom rail 112 includes wheel assemblies (not shown) at both ends of the bottom rail 112. The wheel assemblies guide the bottom rail 112 within the track guides 114. The wheel assemblies can be constructed to reduce friction during normal operation of the curtain assembly. In some embodiments, bottom rail 112 can define a tubular structure in which weights can be placed. In other embodiments, bottom rail 112 defines an elliptical structure to which curtain 108 can be attached. In another example, curtain 108 can form a pocket at the base of the curtain in which bottom rail 112 can be located.

Optionally, bottom rail 112 can be attached to tension cables 116 and tension boxes 118. Tension cables 116 and tension boxes 118 can be configured in conjunction with weights 120 to assist in operation of the curtain 108 between open and closed positions. In some embodiments, tension cables 116 and 118 can be used instead of weights at 120. The tension boxes 118 exert a force on the bottom rail 112 pulling the bottom rail 112 towards the tension boxes through tension cables 116.

Mounting brackets 102 at the end of the roll tube 104 mate with mounting structures (not shown) that can be installed on a given surface. In one example, mounting brackets 102 are positioned for installation at the top of a window. In some settings, mounting brackets 102 can be positioned within a frame of a window. Track guides 114 can be installed below and/or adjacent to the mounting brackets 102. Track guides 114 can be installed on the side edges of a window frame. In some embodiments, track guides can be installed adjacent to a window frame so that the curtain assembly can cover the window and the frame.

Returning to FIG. 2, shown is an example track assembly which includes a track guide 208. Track guide 208 defines a first channel 210 constructed and arranged to house a portion of track insert 204. Track insert 204 is moveably coupled to track guide 208. A portion of track insert 204 is positioned within the first channel 210 and at least a portion of a yoke of the track insert 204 is positioned within a second channel 217 defined by a first 218 and second flange 220 of the track guide 208. Track insert 204 includes a first 222 and second cap 224 portions that are constructed to hold the track insert 204 in the first channel 210 and second channel 217. The first 222 and second 224 cap portions operate in conjunction with a base portion 226 of the track insert 204 to hold the track insert in place. In some embodiments, the track insert 204 can include compressible portions 228.

In some examples, the compressible portions 228 can be constructed of felt, sponge material, rubber, bristles or other compressible material. The compressible portions 228 can be configured to permit side to side movement of track insert 204 in the second channel 217. According to some embodiments, the capability of side to side movement assists in the operation of the curtain assembly. During periods of increased pressure on the curtain (e.g., 108 in FIG. 1) compressible portions 228 can be compressed relieving tension in the curtain and insuring the curtain does not become bound in place during operation.

When a curtain is moved between the open and the closed positions or anywhere in between the portion of the curtain or the portion of the zipper edge will move freely in channel 206. Additionally, a bottom rail 230 of the curtain assembly is also configured to move freely within a third channel 212 defined by the track guide 208. A wheel assembly 232 assists in free movement of the bottom rail 230 in the third channel 212. The wheel assembly 232 may comprise a single wheel and an axis connecting the wheel to the bottom rail 230. In other embodiments, different configurations can be employed including, for example, ball bearing structures, or other structures that are configured to reduce friction between the bottom rail 230 and the track guide 208 as the bottom rail 230 and/or curtain move within the third channel 212. According to one embodiment, the third channel 212 can include housing structures 234. In one example, housing structures 234 are constructed and arranged to include bristles at 236 which also can be configured to maintain the position of bottom rail 230 within the third channel 212 during operation of a curtain assembly. In one alternative, housing structures 234 can be constructed and arranged with felt strips at 236 instead of bristles. Other compressible materials can also be employed at 236 to guide and control movement of the bottom rail 230 during operation of a curtain assembly. In some implementations housing structures 234 and bristles 236 can be omitted.

According to some embodiments, track guide 208 further defines a fourth channel 214. The fourth channel 214 is constructed and arranged to provide greater structural integrity to track guide. In some embodiments, track guide 208 can be fabricated from aluminum and various structures can be constructed, e.g., fourth channel 214, to provide for a desired strength for track guide 208. In some embodiments, the fourth channel can be omitted. In other embodiments different materials can be used to mold, cast, and/or extrude a track guide and a fourth channel 214 can be included as necessary to establish a desired strength for the track guide 208. In one example, the track guide 208 can be constructed of steel. In another example, the track guide 208 can be constructed of plastic.

The material selected and the dimensions of track assembly 200 can vary depending upon a given installation site.

Materials can be selected based on aesthetic as well as based on structural considerations. In one example, the dimensions of the track guide can be 1.44 inches at 252, 0.67 inches at 254, 0.79 inches at 256, 1.255 inches at 258, 1.93 inches at 572, and 0.47 inches at 260. In other embodiments, different dimension can be employed. Further, different material used to construct the track guide 208 can require different dimensions and/or permit smaller installation dimensions.

Figure 3:
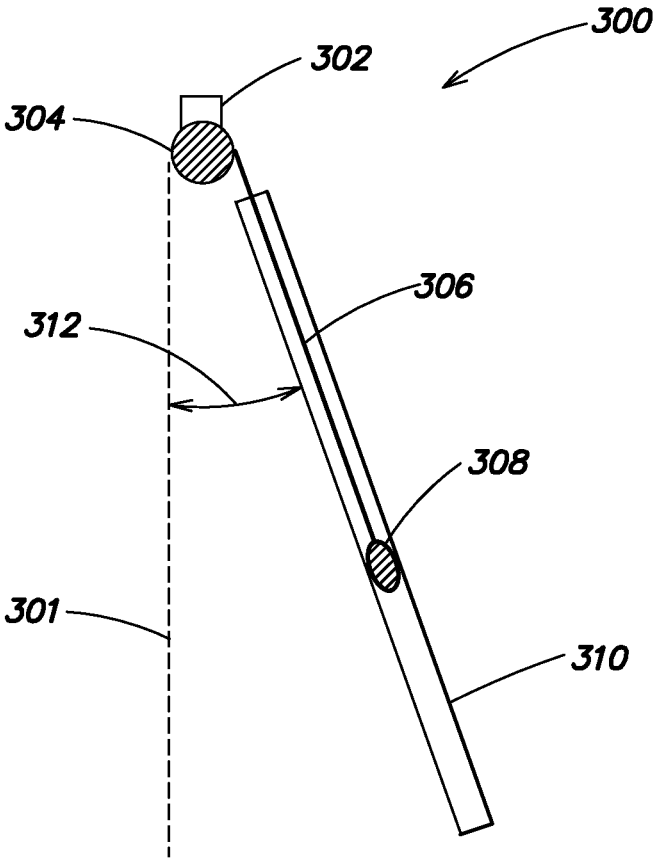
FIG. 3 illustrates an example curtain assembly in a side view installed and operable along a slope, according to one embodiment.

Shown in FIG. 3, is an example curtain assembly 300, illustrated in a side view, installed and operable along a slope. Dashed line 301 illustrates a hypothetical plumb line drawn from the top of the installation position. In some settings, the installation slope shown by angle 312 follows an irregularly shaped structure, for example a slopping wall, window, etc. In some embodiments, the curtain assembly can be installed and be operable in a horizontal position, e.g., where angle 312 is 90 degrees from line 301. The curtain assembly is mounted to the structure to be covered (e.g., window, frame, opening) via mounting brackets at 302. The mounting brackets are coupled to a roll tube 304 around which a curtain 306 is wound. Typically, the curtain assembly is configured for installation in an interior of a building, house or other residential structure. In some embodiments, the curtain 306 can be constructed of a flat panel of cloth and/or fabric. In one example, the curtain comprises a single flat panel wound around roll tube 304. In other examples, the fabric can be woven from artificial and/or natural fibers. Optional curtain stiffeners (not shown) can be employed to maintain the flat shape of the curtain during operation. Further, stiffeners can be required when covering windows, as air flow through open windows can tend to distort the shape and appearance of a fabric and/or cloth curtain.

In other embodiments, tension provided by opposite track guides, e.g., 310, to which the curtain is attached, can maintain the shape and appearance of the curtain 306 during operation and in any fixed position. Further, weight provided by bottom rail 308 can also provide tension within the curtain 306 that maintains the shape and appearance of the curtain 306. The weight of bottom rail 308 can be adjusted based on the tension desired in the curtain 306 and an installation slope at which curtain assembly 300 is installed. Bottom rail 308 and curtain 306 are guided within track guide 310 during operation of the curtain assembly between an open position, where the curtain is wound around roll tube 304 and a closed position where curtain 306 is unwound from roll tube 304 to cover the opening on which curtain assembly 300 is installed.

Curtain 306 is configured to be moveable to occupy any position along track guide 310 based on rotation of roll tube 304. In some embodiments, the rotation of roll tube 304 can be accomplished via a draw string mechanism (not shown) or other motorized structures (not shown) for rotating roll tube 304 in both directions. In other embodiments, curtain 304 can be configured to be in an equilibrium state when not moving, but configured to tend towards a direction of motion when operated, for example, by hand. In some embodiments, springs can be installed in roll 304 to balance the weight applied by bottom rail 308, so that curtain 306 can be easily manipulated by hand.

According to another aspect, a retractable curtain assembly is provided for installation in openings having angled sides, including angled top, bottom, and side edges. Conventional curtains are installed about or abutting windows to cover rectangular openings. Traditionally, windows or other exterior openings are configured with squared or nearly squared edges which present rectangular or squared spaces. Squared and rectangle openings can be covered during the operation of conventional curtains. Operating curtain assemblies within and/or over irregularly shaped openings presents difficulties that some conventional curtains cannot overcome. According to one embodiment, a retractable curtain assembly is configured to provide complete coverage of an opening as the dimensions of the opening change. In one particular embodiment, the curtain assembly is configured to cover a trapezoidal window. According to another example, a variable length bottom rail can be configured to expand and contract during the transition between an open and closed position of a curtain to insure proper coverage of the trapezoidal window. In another embodiment, the variable length bottom rail is configured to ride within a track guide. In one example, the variable length bottom rail is connected to a wheel assembly that is constructed and arranged to fit within a channel defined in the track guide. During transitions between an open and closed position, the wheel assembly is configured to exert pressure on the variable length bottom rail, causing the variable length bottom rail to expand or contact lengthwise to fit within the opening defined by the track guide.

According to one aspect, a curtain assembly is provided. The curtain assembly comprises a curtain selectably moveable between an open position and a closed position connected to a variable length bottom rail, a track guide that defines a side of a plane of operation of the curtain as it moves between the open position and the closed position, the variable length bottom rail constructed and arranged to vary in length as a distance between a pair of track guides varies, and a wheel assembly moveably coupled to the track guide, wherein the variable length bottom rail is coupled to the wheel assembly, and the wheel assembly is configured to exert force on the variable length bottom rail causing the variable length bottom rail to expand and contract in response to changing distances between the pair of track guides during transition between the open and the closed position. According to one embodiment, the curtain assembly further comprises at least one stiffener elements constructed and arranged to maintain a shape of the curtain within the plane of operation. According to one embodiment, the curtain is a fabric curtain. According to one embodiment, the plane of operation is defined on a slope. According to one embodiment, the slope is greater than 10 degrees. According to one embodiment, the slope is greater than 20 degrees. According to one embodiment, the slope is greater than 30 degrees. According to one embodiment, the slope is greater than 40 degrees.

Figure 4:
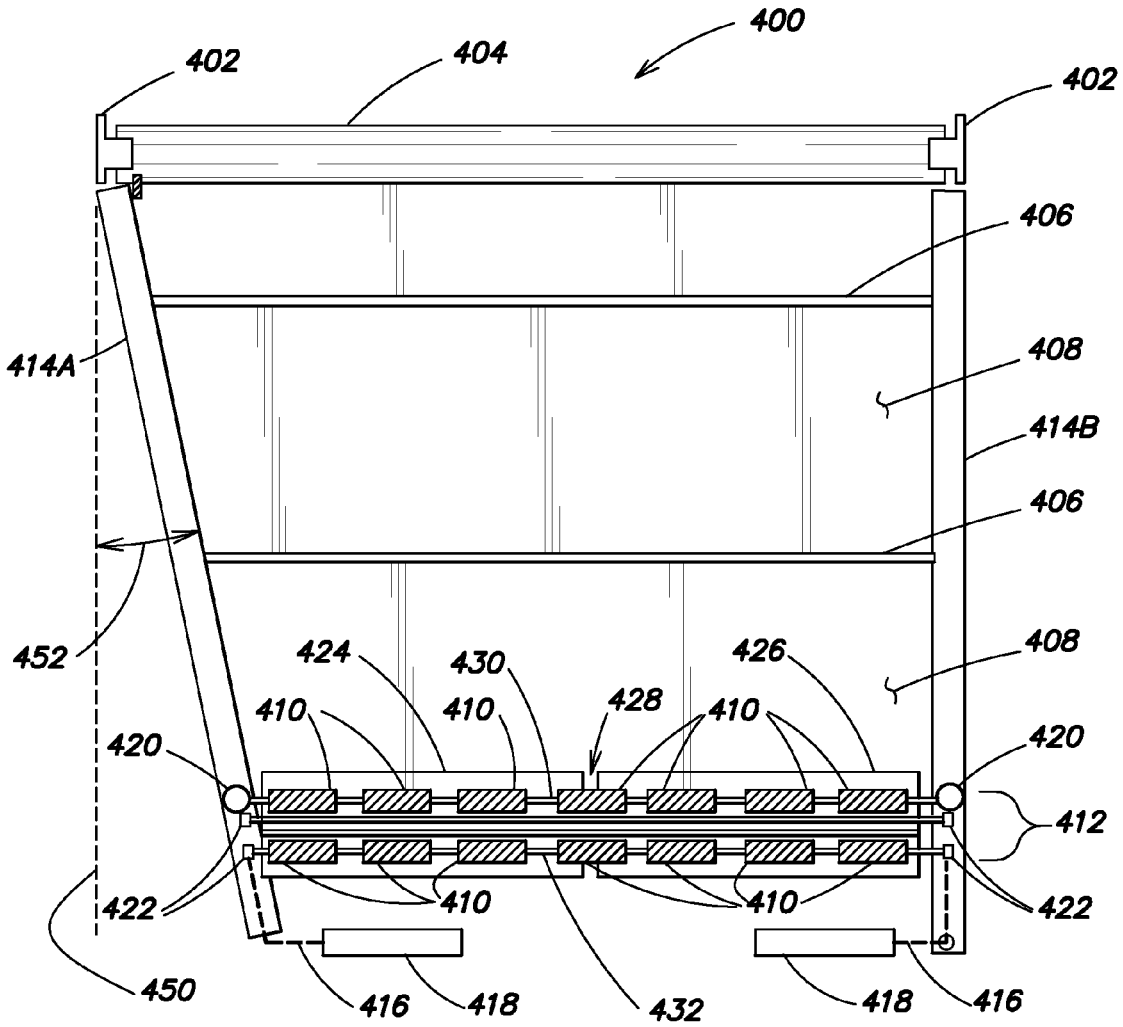
FIG. 4 illustrates an example curtain assembly constructed and arranged to cover irregularly shaped openings, according to one embodiment.
Figure 6:
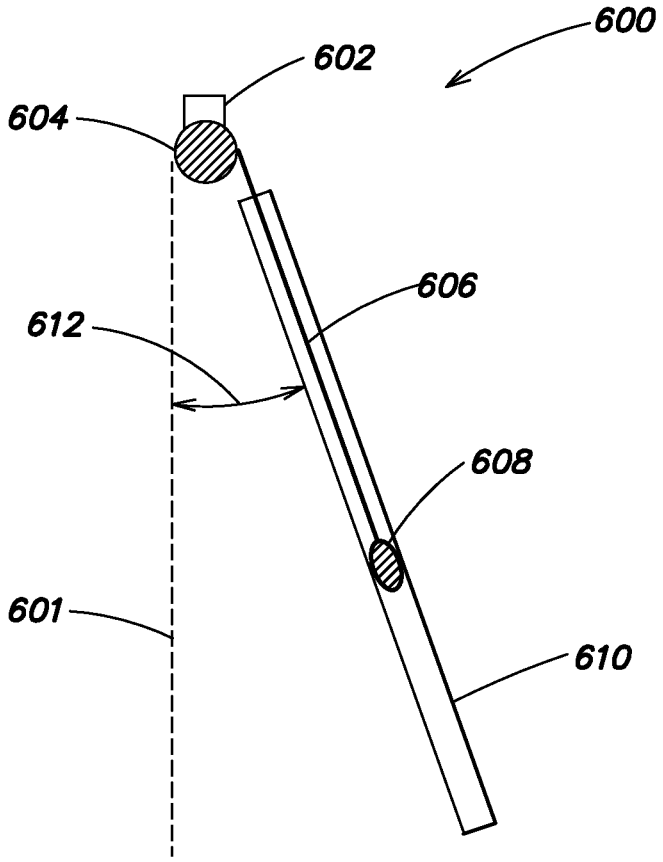
FIG. 6 illustrates an example curtain assembly, according to one embodiment.

FIG. 4 illustrates an example embodiment of a curtain assembly 400 incorporating some aspects of the present disclosure. Curtain assembly 400 is constructed and arranged to cover irregularly shaped openings, for example windows, frames, doors, etc. The irregular shapes can include trapezoids, triangles, partial ellipses, etc. According to some embodiments, the curtain assembly can be installed over such irregular openings even where the opening is constructed on a sloped surface, window, and/or other opening, requiring the curtain assembly to operate on a sloped plane, as shown in FIG. 6.

The curtain assembly 400 includes mounting brackets 402 for installing a roll tube 404 having a curtain 408 that covers, for example, a window. In some examples, the curtain 408 is made of fabric. In other examples, the fabric curtain can be made of natural fibers, and in others can be constructed of artificial fibers. In some other examples, the curtain can be constructed of a blend of natural and artificial fibers. According to one embodiment, the fabric curtain 408 is a flat sheet of fabric wound around the roll tube 404. Rotation of roll tube 404 causes curtain 408 to transition between an open (recessed) and a closed (extended) position. The rotation of roll tube 404 can be controlled via a drawn string (not shown) or in some embodiments curtain assembly 400 can include motors for rotating roll tube 404 (not shown). The curtain 408 may include fabric stiffeners 406 to provide rigidity. Fabric stiffeners 406 can be constructed of various materials, including metal bands fixed to one or more sides of the curtain. In some embodiments, the fabric stiffeners 406 can be omitted.

According to one embodiment, curtain 408 is attached to a bottom rail 412. Bottom rail 412 is constructed and arranged to assist in the operation of the curtain assembly 400 between an open position and a closed position. In some embodiments, bottom rail 412 includes a wheel assembly 420 and stabilizer pins 422 at both ends of the bottom rail 412. The wheel assemblies 420 guide the bottom rail 412 within the track guides 414. The stabilizer pins 422 ride within the track guides 414A-B and insure the bottom rail 412 does not rotate during operation. The wheel assemblies 420 can be constructed to reduce friction during normal operation of the curtain assembly. Further, the wheel assemblies 420 mate with an internal channel constructed within the track guides 414A-B. As the wheel assemblies 420 travel in the channels constructed in the track guides 414, the change in distance between the wheel assemblies 420 results in an operational force applied to the bottom rail 412. The operational force applied to the bottom rail 412 causes the bottom rail 412 to change in length as the bottom rail is moved along the track guide 414. The change in length required depends upon the structure in which the curtain assembly is installed. Dashed line 450 illustrates a hypothetical plumb line drawn from mounting bracket 402. The angle of the slope 452 can vary depending upon the installation site. Further, track guides 414A-B are illustrated with only one track guide 414A showing a sloped installation. In other embodiments, both track guides can be installed at angles relative to respective plumb lines. Further curtain assembly 400 can be configured to operate over and/or within a variety of structures having differently sloping sides, top, and/or bottom edges. In some other embodiments, not only may structure have irregularly shaped edges, top, and/or bottom sides, requiring the track guides to be sloped, but the plane of operation of the curtain itself may also be sloped. An example of a curtain assembly showing a sloped plane of operation is illustrated in FIG. 6.

Returning to FIG. 4, in some embodiments, the bottom rail 412 is constructed of a first portion 424 and a second portion 426, which move laterally relative to each other as the bottom rail is operated up and down within track guide 414. The opening shown at 428 expands and contracts based on the movement of bottom rail 412. Not shown in FIG. 4 is a sleeve that surrounds the first 424 and second portion 426 of the bottom rail to cover the opening 428 during operation of the curtain assembly 400. The sleeve is constructed to provide a surface for the curtain 408 during the telescoping of bottom rail 412.

In some embodiments, the bottom rail 412 can define a tubular structure in which weights can be placed. In other embodiments, the bottom rail 412 defines an elliptical structure to which curtain 408 can be attached. In another example, curtain 408 can form a pocket at the base of the curtain in which the bottom rail 412 can be located. In one embodiment, stabilizer bars 430 and 432 can be constructed within the bottom rail 412. In one example, either one or both stabilizer bars 430-432 can be fixed to one side of the bottom rail 412. The first portion 424 and the second portion 426 of the bottom rail 412 are configured to slide over stabilizer bars 430-432 as the bottom rail 412 expands and contracts in length during operation of the curtain assembly 400.

Optionally, bottom rail 412 can be attached to tension cables 416 and tension boxes 418 to assist in moving the curtain assembly 400 between the open and closed positions. The tension cables 416 and tension boxes 418 can be configured in conjunction with weights at 410 to assist in operation of the curtain 408 between the open and closed positions. Tension boxes 418 exert a force on bottom rail 412 through tension cables 416 towards the closed position of curtain 408.

In some embodiments, the bottom rail 412 can include weights at 410. The weights 410 are configured to assist in unwinding the curtain 408 from the roll tube 404 into a closed position and to provide resistance as the curtain 408 is wound around roll tube 404 towards an open position. The weights 410 can be attached to stabilizer bars 430-432. In some alternatives, the weights 410 can be disposed within the bottom rail 412. In some embodiments, the weights at 410 are optional. In horizontal implementations, for example, weights at 410 provide little or no assistance in operation of the curtain assembly. In some embodiments, tension cables 416 and 418 can be used instead of weights at 410.

Mounting brackets 402 at the end of the roll tube 404 mate with mounting structures (not shown) that can be installed on a given surface. In one example, mounting brackets 402 are positioned for installation at the top of a window. In some settings, mounting brackets 402 can be positioned within a frame of a window. The track guides 414A-B can be installed below and/or adjacent to the mounting brackets 402. The track guides 414A-B can be installed on the side edges of a window frame and configured to follow non-traditional shapes. In some examples, the covered structure may define a trapezoid, a triangle, etc. In some embodiments, the track guides can be installed adjacent to a window frame so that the curtain assembly can cover both the window and the frame.

Figure 5:
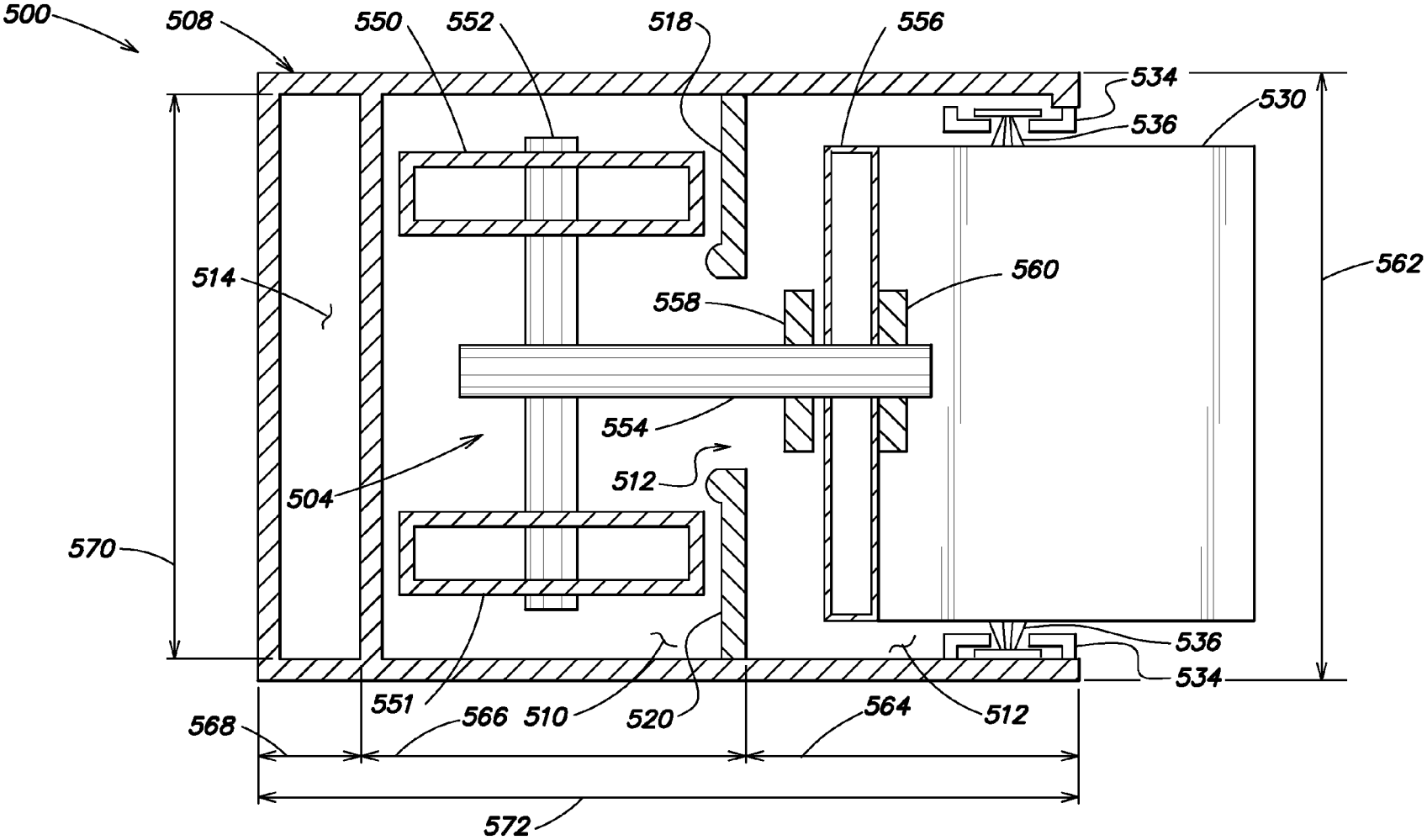
FIG. 5 illustrates an example track assembly according to one embodiment.

Shown in FIG. 5, is an example track assembly 500. Track assembly 500 is a cross section view of a track guide 508 and other structures which illustrate a portion of a curtain assembly including a curtain attached to roll tube and a bottom rail. The curtain assembly is configured to operate between an open and closed position by rotation of the roll tube, during which operation a bottom rail 530 rides along the track guide 508, with the bottom rail 530 expanding and contracting in length as necessary. According to some embodiments, the track guide 508 is installed at a slope relative to a second track guide (not shown). The slope of track guide 508 results in a variable distance between the track guide 508 and the second track guide requiring the bottom rail 530 to expand and/or contract as the bottom rail 530 travels the length of the track guide 508 and the second track guide.

The track guide 508 includes a first channel 510 constructed and arranged to house a wheel assembly 504. The wheel assembly 504 is moveably coupled to the track guide 508 within the first channel 510. During operation of the curtain assembly (e.g., the raising and lowering of a curtain and attached bottom rail) the wheel assembly 504 rides within the first channel 510 as the bottom rail moves with the curtain. According to one embodiment, the wheel assembly 504 is constructed of paired wheels 550 and 551 connected by a first rod 552 about which the wheels 550-551 rotate. The first rod 552 is connected to a second rod 554 which is connected to one end of the bottom rail 530 at a bottom rail end 556. The connection between the second rod 554 and the bottom rail end 556 can include welds or additional structures to secure the second rod 554 to the bottom rail end 556. In one embodiment, second rod 554 can be configured to extend through a hole in the bottom rail end 556, and locking structures 558 and 560 can be configured to hold the second rod 554 in place against bottom rail end 556. In one example, second rod 554 can include threaded portions and locking structures 558 and 560 can be configured to mate with the threaded portions of the second rod 554. In one alternative, the second rod 554 can be attached directly to the bottom rail 530, and the locking structures 558-560 can be omitted. In one example, the second rod 554 can be welded directly to bottom rail end 556. In another alternative, the second rod 554 can include a threaded portion to which the bottom rail end 556 mates.

In one example, the second rod 554 extends through a second channel 517 defined by the track guide 508 between a first 518 and second flange 520 of the track guide 508. The second rod 554 rides within the second channel as the bottom rail 530 travels in the track guide 508. The wheels 550 and 551 of the wheel assembly 504 ride against the first 518 and second flange 520, during operation of the bottom rail 530. As the distance between the track guide 508 and a second track guide increases a force is applied to the bottom rail 530 through the wheel assembly 504 and a respective wheel assembly housed within the second track guide. The force applied to the bottom rail 530 causes its expansion and/or contraction. For example, as shown above with respect to FIG. 4, the bottom rail 412 expands and contracts in length as the curtain assembly 400 is operated between the closed and open position—causing the distance between wheel assemblies at 420 to decrease and increase respectively.

When a curtain is moved between the open and the closed positions or anywhere in between the bottom rail 530 is also configured to move freely within a third channel 512 defined by the track guide 508. According to one embodiment, the third channel 512 can include housing structures 534. In one example, housing structures 534 are constructed and arranged to include bristles at 536 which can be configured to maintain the position of bottom rail 530 within the third channel 512 during operation of a curtain assembly. In one alternative, housing structures 534 can be constructed and arranged with felt strips at 536 instead of bristles. Other compressible materials can also be employed at 536 to guide and control movement of the bottom rail 530 during operation of a curtain assembly. In some implementations housing structures 534 and bristles 536 can be omitted. In some implementations, the housing structures and compressible material at 536 can be configured to dampen sound during operation of a curtain assembly.

According to some embodiments, the track guide 508 further defines a fourth channel 514. The fourth channel 514 is constructed and arranged to provide greater structural integrity to the track guide. In some embodiments, the track guide 508 can be fabricated from aluminum and various structures can be constructed, e.g., fourth channel 514, to provide for a desired strength for track guide 508. In some embodiments, the fourth channel can be omitted. In other embodiments different materials can be used to mold, cast, and/or extrude a track guide and a fourth channel 514 can be included as necessary to establish a desired strength for the track guide 508. In one example, the track guide 508 can be constructed of steel and/or stainless steel. In another example, the track guide 508 can be constructed of plastic.

The material selected and the dimensions of track assembly 500 can vary depending upon a given installation site. Materials can be selected based on aesthetic as well as based on structural considerations. In one example, the dimensions of the track guide can be 1.44 inches at 562, 0.67 inches at 564, 0.79 inches at 566, 1.255 inches at 568, 1.93 inches at 572, and 0.47 inches at 570. In other embodiments, different dimension can be employed. Further, different material used to construct the track guide 508 can require different dimensions and/or permit smaller installation dimensions.

Shown in FIG. 6, is an example curtain assembly 600, illustrated in a side view, installed and operable along a slope. Dashed line 601 illustrates a hypothetical plumb line drawn from the top of the installation position. In some settings, the installation slope shown by angle 612 follows an irregularly shaped structure, for example a slopping wall, window, etc. In some embodiments, the curtain assembly can be installed and operable in a horizontal position, e.g., where angle 612 is 90 degrees from line 601. The curtain assembly is mounted to the structure to be covered (e.g., window, frame, opening) via mounting brackets at 602. The mounting brackets are coupled to a roll tube 604 around which a curtain 606 is wound. Typically the curtain assembly is configured for installation in an interior of a building, house or other residential structure. In some embodiments, the curtain 606 can be constructed of a flat panel of cloth and/or fabric. In one example, the curtain comprises a single flat panel wound around roll tube 604. In other examples, the fabric can be woven from artificial and/or natural fibers. Optional curtain stiffeners (not shown) can be employed to maintain the flat shape of the curtain during operation. Further, stiffeners can be required when covering windows, as air flow through open windows can tend to distort the shape and appearance of a fabric and/or cloth curtain.

Further, weight provided by bottom rail 608 can also provide tension within the curtain 606 that maintains the shape and appearance of the curtain 606. The weight of bottom rail 608 can be adjusted based on the tension desired in the curtain 606 and an installation slope at which curtain assembly 600 is installed. Bottom rail 608 and curtain 606 are guided within track guide 610 during operation of the curtain assembly between an open position, where the curtain is wound around roll tube 604 and a closed position where curtain 606 is unwound from roll tube 604 to cover the opening on which curtain assembly 600 is installed. Curtain 606 is configured to be moveable to occupy any position along track guide 610 based on rotation of roll tube 604. In some embodiments, the rotation of roll tube 604 can be accomplished via a draw string mechanism (not shown) or other motorized structures (not shown) for rotating roll tube 604 in both directions. In other embodiments, curtain 604 can be configured to be in an equilibrium state when not moving, but configured to tend towards a direction of motion when operated, for example, by hand. In some embodiments, springs can be installed in roll tube 604 to balance the weight applied by bottom rail 608, so that curtain 606 can be easily manipulated.

Shown in FIG. 7 is an example embodiment, of an expandable bottom rail 700. The expandable bottom rail 700 can be used in conjunction with various curtain assemblies, and in particular, curtain assemblies installed on, about, and/or within irregularly shaped openings. The expandable bottom rail 700 is configured to accommodate curtain assemblies having variable distances between track guides into which the expandable bottom rail can be installed.

Figure 7A:
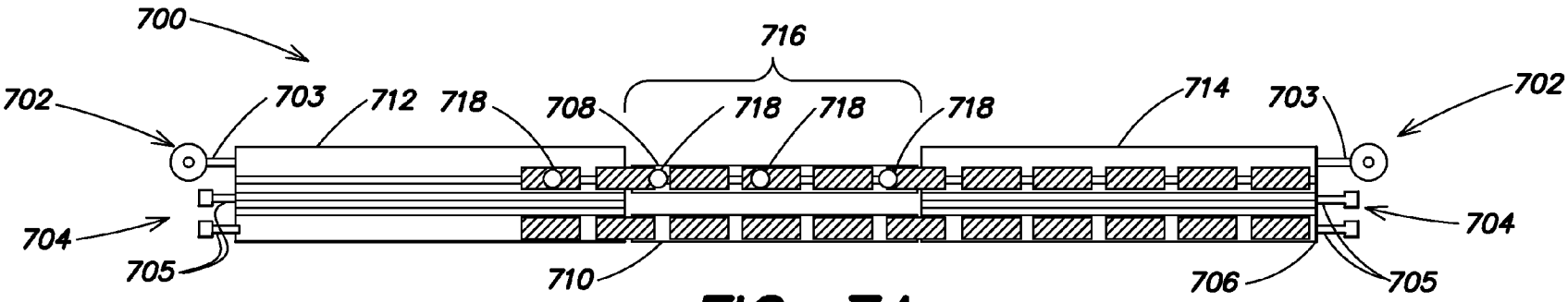
FIG. 7 illustrates an example expandable bottom rail according to one embodiment.

FIG. 7A shows an exploded view of bottom rail 700. Bottom rail 700 includes wheel assemblies 702 coupled to the bottom rail 700 at each end of the bottom rail. A connector section at 703 can include springs which allow the connection section to flex slightly in response to pressure. For example, increased pressure from wind through an open window on a curtain can cause some conventional curtain assemblies to bind, rendering the assembly inoperable. Providing flexible connection sections at 703, for example, permits easy operation of a given curtain assembly even under increased pressure conditions. The wheel assemblies 702 are constructed and arranged to ride within channels defined by track guides that frame a given curtain assembly. The bottom rail 700 can include stabilization pins. In some embodiments each end the bottom rail 700 can include a pair of stabilization pins at 704.

The stabilization pins are configured to prevent the bottom rail 700 from rotating during operation of a curtain assembly. In some embodiments, additional stabilization pins can be employed. In other embodiments, one stabilization pin on each end of the bottom rail can be used.

According to one embodiment, tubes 708 and 710 are fixed to one end 706 of the bottom rail 700. In other embodiments, either tube can be fixed to the end 706 of the bottom rail. In still other embodiments, each tube can be fixed to opposite ends of the bottom rail. And in some implementation, one or more tubes can be employed in bottom rail 700. In some examples, at least one of the one or more tubes can be fixed to an end of the bottom rail. Tubes 708 and 710 can be constructed with wheels at 718 to facilitate the movement of a first section 712 and a second section 714 of the bottom rail 700 relative to each other. During operation of a curtain assembly with sloped track guides, the distance between the track guides increase and decreased over the length of the track guides. Accordingly, expandable bottom rail 700, increase and decrease in length based on the distance between the track guides. The increase and decrease in length occurs based on the lateral movement of the first 712 and section sections 714 relative to each other guided by tubes 708 and 710. One or the other of the first 712 and second 714 sections of the bottom rail 700 can include mating structures not shown for receiving the tubes 708 and 710. In one example, channels can be defined within the first section 712 for receiving tubes 708 and 710. The tubes 708 and 710 can slide freely in the defined channels to permit the first 712 and 714 second section of the bottom rail to move. Movement of the first and second section increase and decreases the space between the first and second sections shown at 716 based on the distance between track guides of a given curtain assembly.

Figure 7B:
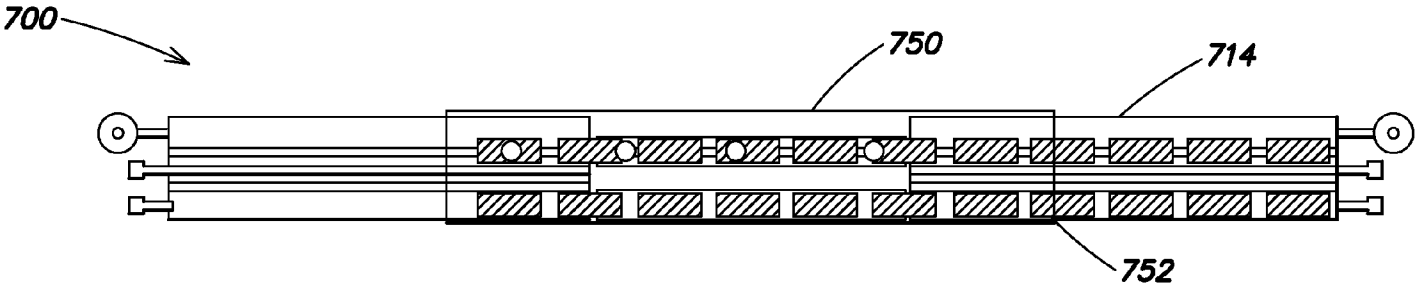

Shown in FIG. 7B is bottom rail 700 with an additional structure, sleeve 750. Sleeve 750 covers the first and second sections of the bottom rail, providing a uniform surface for a curtain of a given curtain assembly. In some embodiments, the bottom rail 700 can be inserted within a pocket defined the by the curtain, and in other embodiments, the curtain be attached to the bottom rail. In some examples, sleeve 750 can be fixed to one or the other of the first 712 and second sections 714 of the bottom rail. In one example, sleeve 750 is fixed to second section 714 at 752.

Figure 8A:
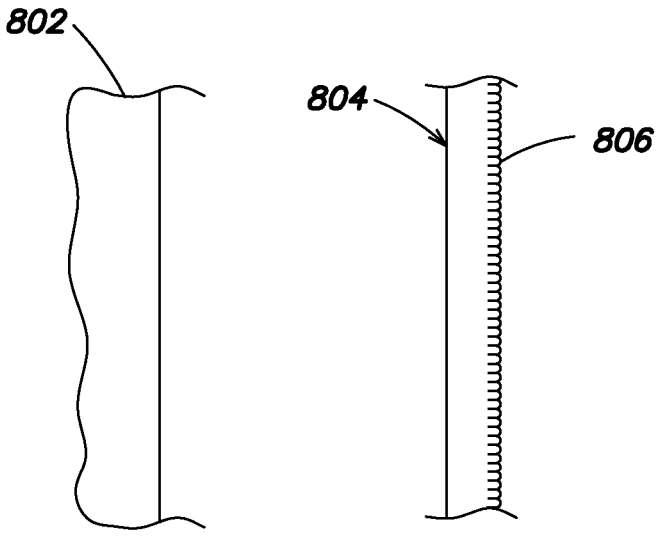
FIG. 8A illustrates an example weld strip, according to one embodiment.
Figure 8B:
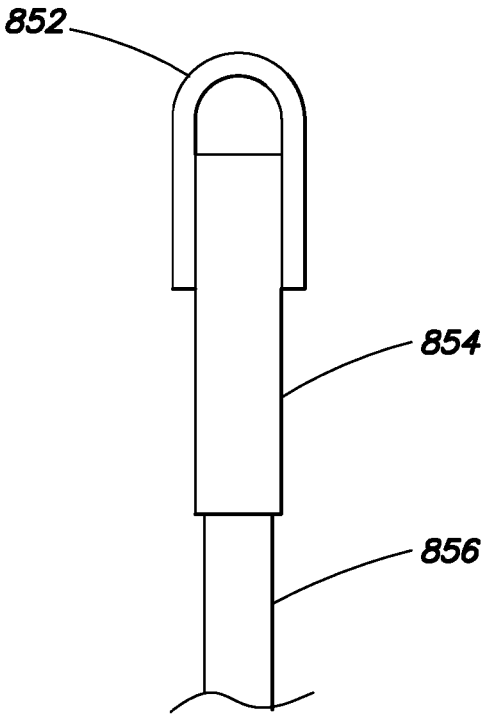
FIG. 8B illustrates an example curtain with adhered weld strip, according to one embodiment.

Shown in FIG. 8A is an example of a weld strip 804 used to attach teeth 806 to a curtain 802. When viewed from the side, as shown in FIG. 8B, teeth at 852 have a greater width than weld strip 854 and curtain 856. The greater width provided by teeth 852 allows the teeth to be moveably coupled to a channel in a track insert, for example, track insert 204 and channel 206 shown in FIG. 2.

Figure 9:
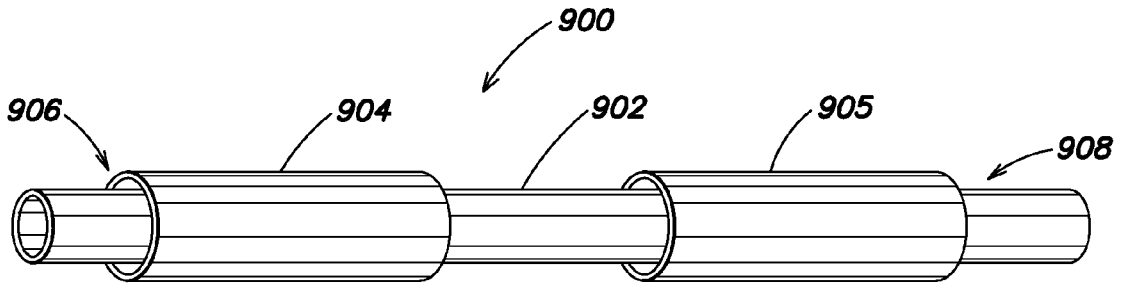
FIG. 9 illustrates an example roll tube used in curtain assemblies, according to one embodiment.

Shown in FIG. 9 is an example of a roll tube for use in curtain assemblies. In the illustrated embodiment, the roll tube is constructed with an inner tube 902 having a smaller circumference than paired outer tubes 904-905. Edge portions 906 and 908 are defined by portions of the inner tube 902 which extend beyond paired outer tubes 904-905. Edge portions 906 and 908 provide space for a portion of a curtain with greater width (e.g., zipper edge 110, FIG. 1) to wind around roll tube 900 during operation of a curtain assembly from a closed position to an open position. The smaller circumference edge portions 906 and 908 provide space, for example, for the zipper edge to be wound around the roll tube without the thickness of the zipper edge impeding operation of the curtain assembly. Other configurations of the roll tube can be employed, wherein a recessed portion is configured on each side of the roll tube to receive a zipper edge of the curtain assembly during winding of the curtain around the roll tube. In some examples the roll tube can be constructed of a single tube with varying thickness at the edges to form edge portions. In other examples, multiple pieces can be assembled to construct a roll tube with edge portions for receiving a zipper edge. In yet other examples, a single interior roll tube can be coupled to a tube on each edge wherein an exposed portion of the edge tubes define edge portions of smaller circumference for receiving, for example, a zipper portion of a curtain. In another embodiment, a roll tube can be configured with an interior recessed portion that is configured for used in multiple curtain installations. The roll tube can be installed to operate two curtains in a curtain assembly.

Figure 19:
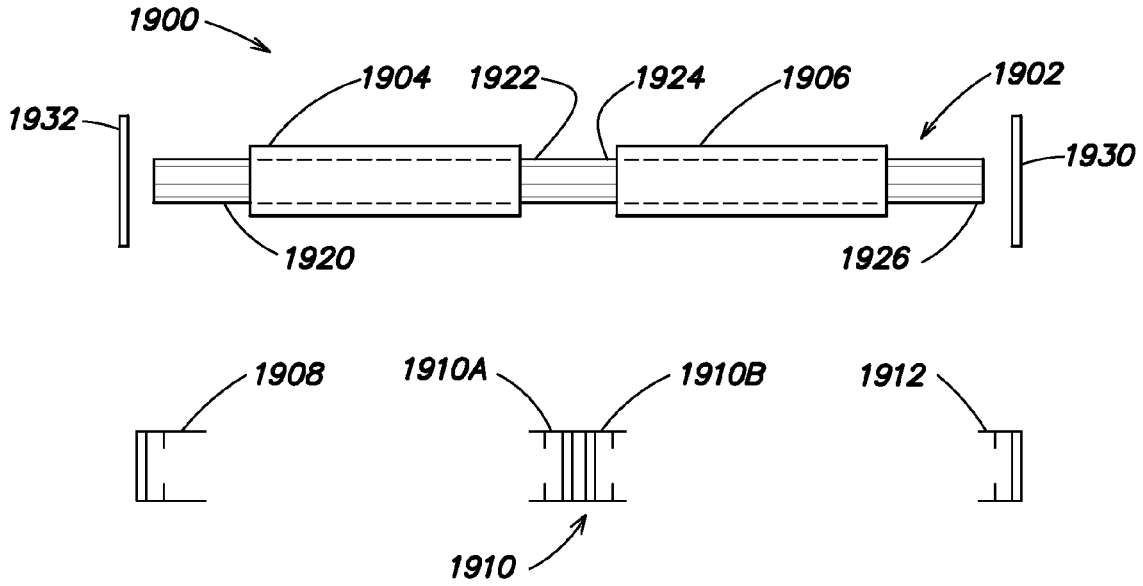
FIG. 19 illustrates an example of a multi-curtain curtain assembly, according to one embodiment.

Shown in FIG. 19, is embodiment of a multi-curtain curtain assembly 1900. Assembly 1900 includes a multi-curtain roll tube 1902. Multiple curtains can be wound on the roll tube 1902 (e.g., at curtain roll portions 1904 and 1906) with each curtain having its own track guides (e.g., 1908 and 1910 and 1910 and 1912). In an interior portion of the curtain assembly, two single track guides can be used each opening towards one of the adjacent curtains (e.g., at positions 1910A and 1910B). In one embodiment a dual track guide can be used. Assembly 1900 illustrates an embodiment of a dual track guide 1910 having track portions for each curtain at 1910A and 1910B. The dual track guide can be constructed with dual structures facing the adjacent curtains (e.g., 1910A and 1910B) so the single dual track guide can assist in the movement of multiple curtains. For example, the structures described above with respect to FIG. 2, are repeated with one set of structures opening towards one of a pair of adjacent curtains and the other set of structures opening towards the opposite direction. Each curtain can have associated offset portions constructed in roll tube 1902. In one embodiment, adjacent to each curtain are offset portions 1920, 1922, 1924, and 1926. The offset portions can be constructed and arranged to have a smaller diameter relative to curtain roll portions 1904 and 1906 at which curtains may be attached. The smaller diameter can be configured to accept any additional width associated with, for example, a zipper edge of a curtain connected at 1904 and/or 1906. Illustrated at 1930 and 1932 are portions of a head box which can enclose assembly 1900. In some examples, assembly 1900 can be connected at 1930 and 1932 to a head box. The connections at 1930-32 enable the roll tube to be rotated, which results in operation of any connected curtain between open and closed positions.

According to another aspect, curtain assemblies can be constructed and arranged with overlapping curtains and corresponding structures. According to one embodiment, a multiple roll tube head box can be employed to cover multiple roll tubes which house any number of curtains configured for a given area. FIGS. 1 and 2 illustrate examples of the components of a single curtain curtain assembly. In some embodiments, multiple curtains can be installed in the same area by layering two single curtain assemblies over the same area. In some implementations, multiple tracks (e.g., as shown in FIG. 2 for a single curtain) can be installed over each other to provide for tracked operation of multiple curtains. Some arrangements of multiple curtain assemblies can include offset roll tubes for housing the multiple curtains.

Figure 10A:
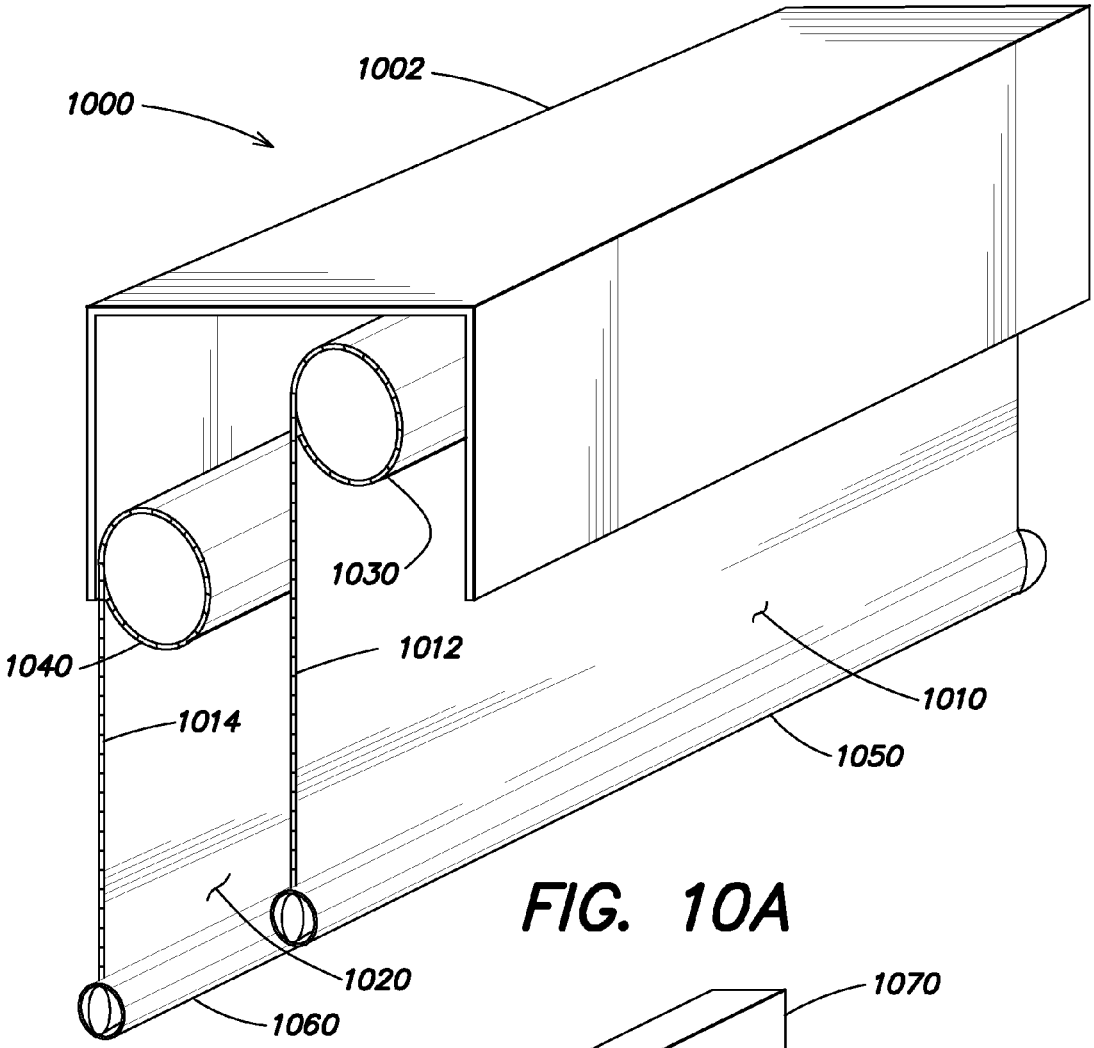
FIGS. 10A-B illustrate example embodiments of multiple curtain curtain assemblies.
Figure 10B:
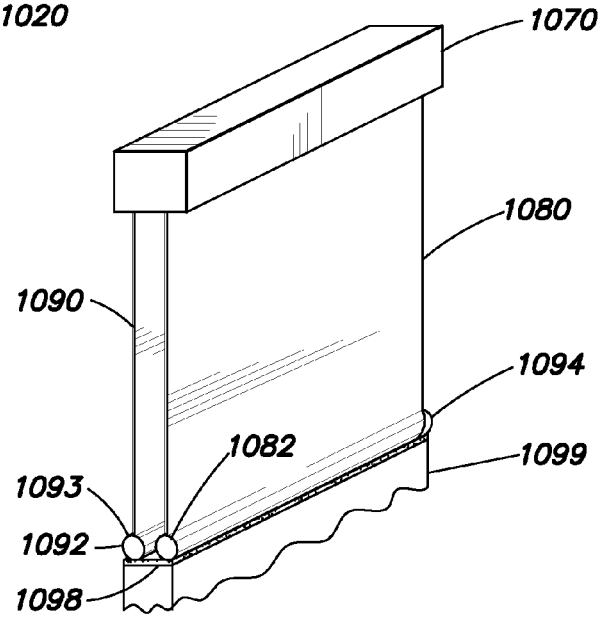

Shown in FIG. 10A is an example embodiment of a curtain assembly 1000 having multiple curtains 1010, 1020, and offset roll tubes 1030 and 1040. Shown in FIG. 10A is a cross section of the head box 1002. The tracks and track inserts have been excluded for purposes of clarity. Each curtain has a zippered edge 1012, 1014 that is configured to ride within a track and track insert installed at the edges of the curtain assembly. The tracks can be separate or integrated to provide a single structure with multiple track spaces configured to hold multiple curtains in place during operation. Curtains 1010 and 1020 can be configured to operate together. In some embodiments, curtains 1010, 1020 can be configured to move between open and closed positions together. In some further embodiments, the bottom rails of each curtain 1050, 1060 can also be configured to seal against any opening covered by the curtain assembly (not shown). In FIG. 10B, illustrated in cross section is an example of a curtain assembly installed in a recessed window frame. The frame 1099 can be configured with a compressible portion 1098 to improve a seal between curtains 1080, 1090, their respective bottom rails 1093, 1094 and the recessed window frame.

Use of overlapping curtains in various curtain assemblies can achieve significant improvements in sound reduction and energy efficiency in terms of insulating power. Upon mating with the recessed frame at 1098 and air pocket between curtains 1080 and 1090 assists in reducing noise and provides a greater capacity than either curtain alone in preventing changes in energy through the covered area. In some implementations, the air pocket between curtains 1080, 1090 increases the curtain assembly's R value (a measure of thermal resistance conventionally used in construction). The improvement in thermal resistance is realized even during movement of the curtains between open and closed positions and in various fixed positions between open and closed. In addition to thermal resistance improvement, noise reduction capability is also improved in various embodiments.

Figure 12:
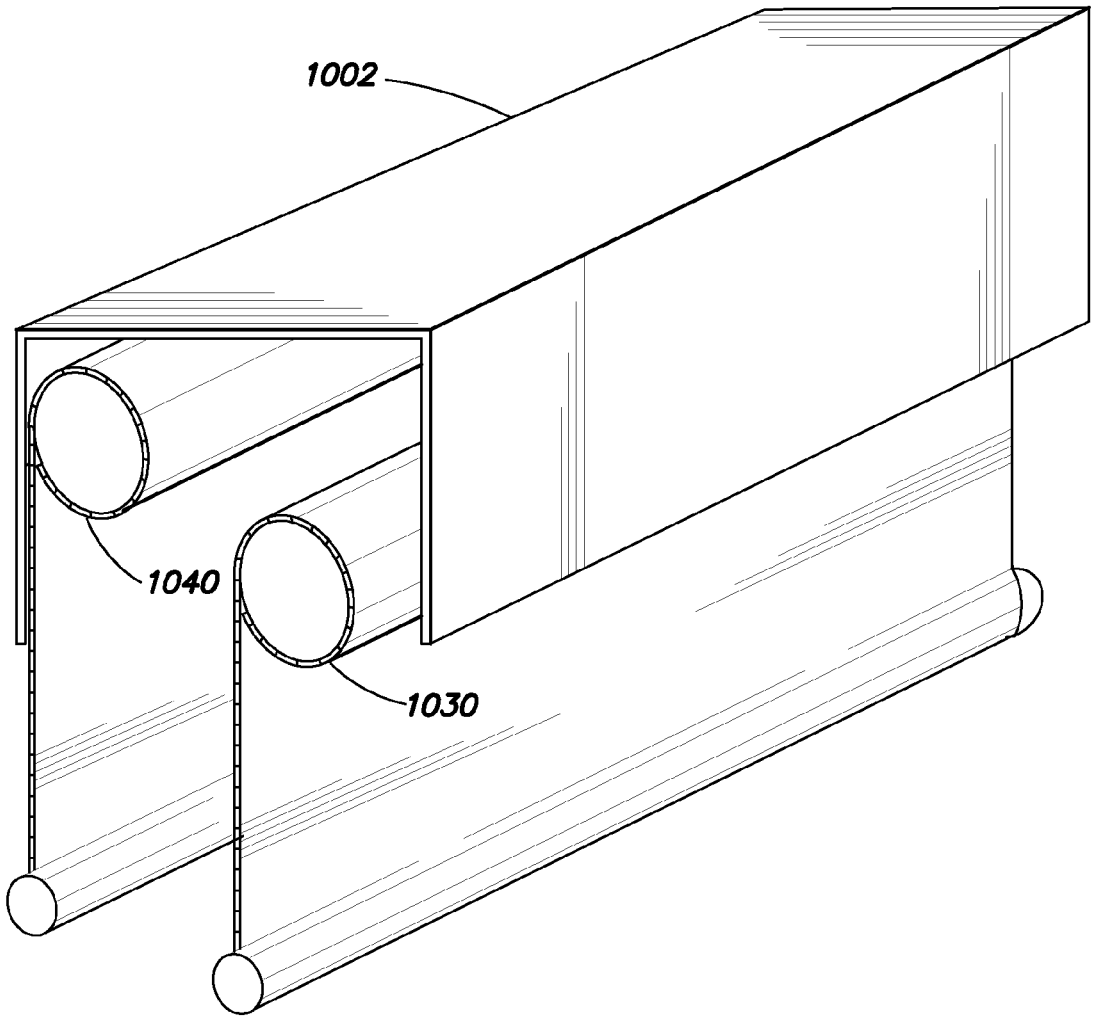
FIG. 12 illustrates an example implementation of a curtain assembly having multiple curtains, according to one embodiment.

Shown in FIG. 12 is another example implementation of a curtain assembly having multiple curtains. FIG. 12 illustrates an alternate configuration of curtain assembly 1000, with offset roll tubes 1030 and 1040 having different positions within head box 1002. Different configurations of the offset roll tubes can be employed in conjunction with motorized operation of the roll tube—different configurations can be employed, for example, to provide space within head box 1002 for the installation of motor components.

Figure 11:
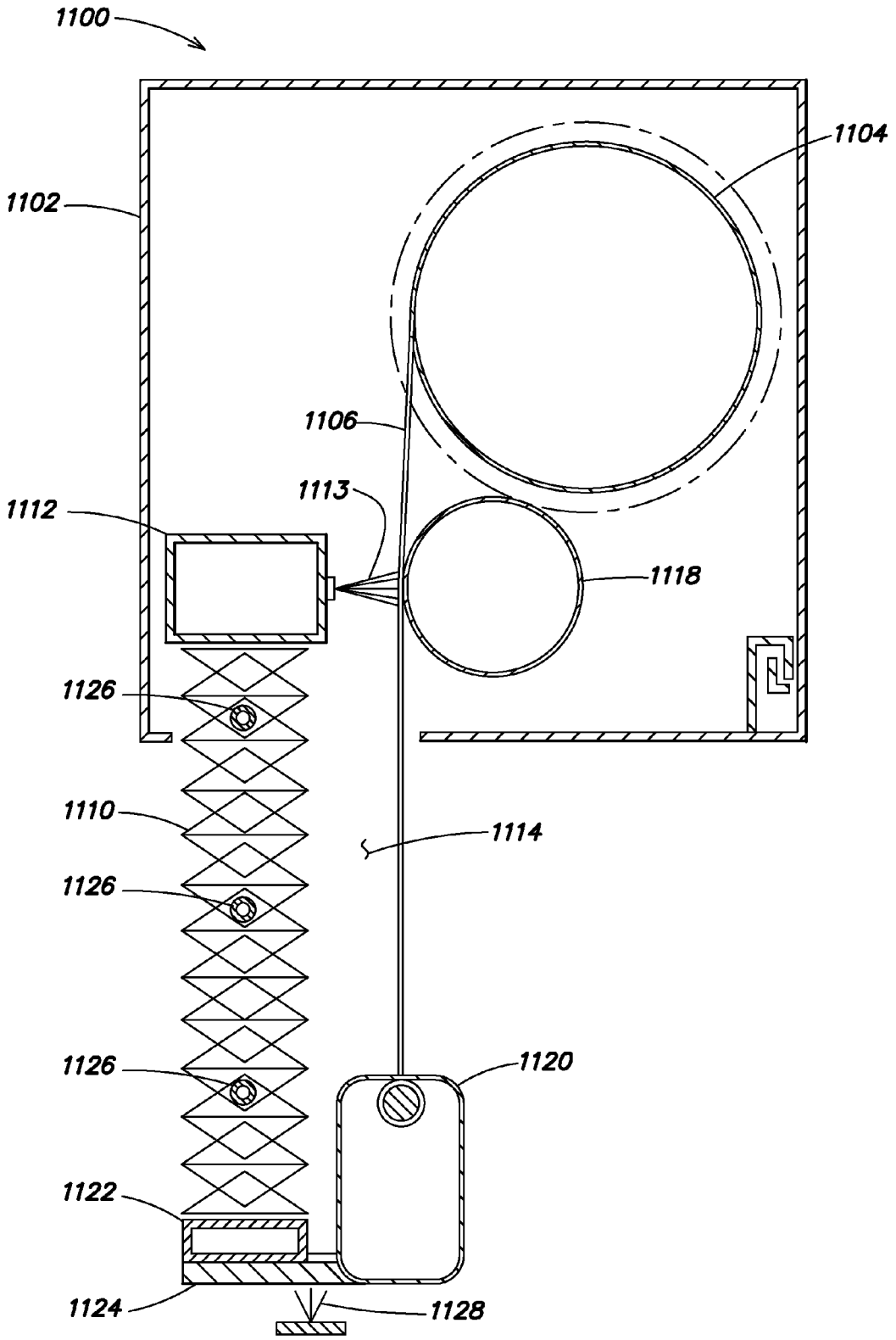
FIG. 11 illustrates an example curtain assembly, according to one embodiment.

Shown in FIG. 11 illustrates an example curtain assembly. According to one embodiment, curtain assembly 1100 can incorporate different types of curtains to achieve improvements in R value and/or noise reduction. FIG. 11 illustrates a cut out side view of the curtain assembly 1100. Curtain assembly 1100 includes a head box 1102 for housing a roll tube 1104 and other curtain assembly structures. Roll tube 1104 is configured to wind and unwind a curtain 1106 to position the curtain 1106 at or between an open and a closed position. In one embodiment, curtain 1106 can be a fabric curtain. A second curtain 1110 can also be housed in head box 1102. The second curtain 1110 can be a different type of curtain than the curtain 1106. In some embodiments, the second curtain faces the opening to be covered by an installed curtain assembly. The curtain 1106 can cover the second curtain 1110 when viewed from an interior location. For example, is the curtain assembly covers an exterior window, the second curtain 1110 can be positioned closest to the window, with the curtain 1106 covering the second curtain from an interior perspective.

The second curtain can be selected based on its energy properties, including for example, a desired R value, or noise reduction capability. In some examples, this allows the curtain 1106 to be selected based on aesthetic properties. According to some embodiments, the second curtain 1110 is constructed of a cellular fabric. Cellular fabric curtains are known to provide good energy properties based on air pockets formed within the cellular member of the curtain. A cellular curtain can have multiple layers of cellular members.

The second curtain 1110 can be constructed and arranged to create an air pocket 1114 between the curtain 1106 and the second curtain 1110. In some implementations, the air pocket improves the R value for the curtain assembly. In some embodiments, the air pocket is employed for improving noise levels of the separate curtains that make up the curtain assembly.

Roller Guide 1118 can be installed to insure curtain 1106 is mated to the second curtain 1110. In one example, a head rail 1112 mated to the second curtain can be fixed to the head box 1102. The head rail 1112 for the second curtain can be constructed with a flexible portion 1113. The flexible portion 1113 can comprise bristles, a fabric strip, or a resilient and compressible material. The flexible portion 1113 is positioned to form a connected between the head rail 1112 and the curtain 1106 through the flexible portion 1113. The flexible portion allows for movement of the curtain 1106, for example during operation of the curtain, while maintaining the connection. The roller guide 1118 can also be position to insure a connection between the head rail 1112 and the curtain 1106 or between the curtain 1106 and the second curtain 1110. In some embodiments, the roller guide can also be configured to permit some deflection to assist in the operation of the curtain 1106 while maintaining the connection between the curtain 1106 and the second curtain 1110. The connection between flexible portion 1113 and the curtain 1106 can form an upper boundary for the air pocket 1114.

In some embodiments, a bottom rail 1120 can be attached to curtain 1106. The bottom rail can be attached to a second bottom rail 1122 fixed to the second curtain 1110. The base 1124 of the curtain assembly where the bottom rails 1120 and 1124 connect can form the to bottom boundary for the air pocket 1114. The side boundaries for the air pocket 1114 are not shown in FIG. 11. In some embodiments, the side boundaries for the air pocket 1114 occur at guide tracks in which curtain 1106 and 1110 are configured to operate in. For example, a tracked curtain assembly is shown in FIG. 1, where a curtain is held in place using a zippered edge portion that rides within a track insert held within a track guide—shown by way of example in FIG. 2. Curtain 1106 and the second curtain 1110 can operate within respective tracks, and the connection between the curtains and the tracks establish the side boundaries for the air pocket 1114. In some embodiments, the second curtain can comprise a cellular fabric. The cellular fabric can also include stiffener guides at 1126. In some embodiments, the stiffener guides 1112 can be constructed and arranged to operate within a track guide and a track insert, similar to a curtain having a zippered edge. In other embodiments, the stiffener guides can be constructed and arranged to operate within a track as shown in FIG. 5. For a given opening, the flexible portion 1128 can be positioned so the curtain assembly forms a proper seal over the covered opening. In one example, a base portion of the curtain assembly can also be constructed to mate with a flexible portion 1128. For example, a flexible portion 1128 can be installed at the base of a window frame to insure a seal between the base 1124 of the curtain assembly and the window frame.

Figure 13:
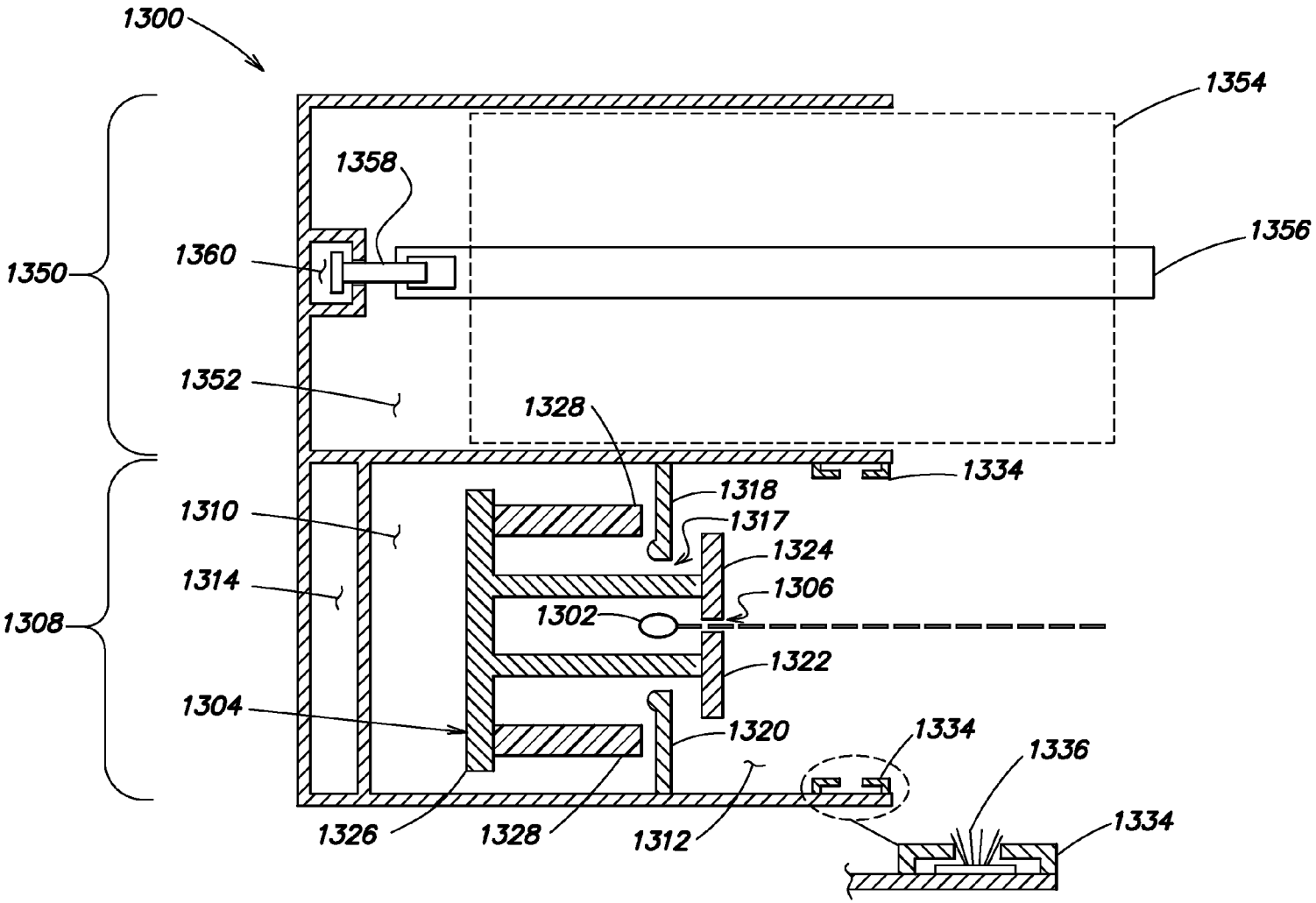
FIG. 13 illustrates an example track assembly, according to one embodiment.

FIG. 13 illustrates one embodiment of a track assembly 1300 including an integrated guide track configured for operation of a multiple curtain curtain assembly, wherein at least one curtain is constructed and arranged of cellular fabric and at least one curtain is constructed and arranged of a flat fabric sheet.

FIG. 13, shown is an example track assembly for multiple curtains which includes a track guide portion 1308. Track guide portion 1308 defines a first channel 1310 constructed and arranged to house a portion of track insert 1304. Track insert 1304 is moveably coupled to track guide 1308. A portion of track insert 1304 is positioned within the first channel 1310 and at least a portion of a yoke of the track insert 1304 is positioned within a second channel 1317 defined by a first 1318 and second flange 1320 of the track guide 1308. Track insert 1304 includes a first 1322 and second cap 1324 portion that are constructed to hold the track insert 1304 in the first channel 1310 and second channel 1317. The first 1322 and second 1324 cap portions operate in conjunction with a base portion 1326 of the track insert 1304 to hold the to track insert in place. In some embodiments, the track insert 1304 can include compressible portions 1328. Compressible portions 1328 can be constructed and arranged of a compressible sponge material. In some examples, the material can be selected to increase noise reduction properties of a curtain assembly.

In some examples, the compressible portions 1328 can be constructed of felt, sponge material, rubber, bristles or other compressible material. The compressible portions 1328 can be configured to permit side to side movement of track insert 1304 in the second channel 1317. According to some embodiments, the capability of side to side movement assists in the operation of the curtain assembly. During periods of increased pressure on a curtain compressible portions 1328 can be compressed relieving tension in the curtain and insuring the curtain does not become bound in place during operation.

When a curtain is moved between the open and the closed positions or anywhere in between the portion of the curtain or the portion of the zipper edge will move freely in channel 1306. Additionally, a bottom rail (not shown) of a curtain assembly can be configured to move freely within a third channel 1312 defined by the track guide 1308. In some examples, a bottom rail can be constructed with a wheel assembly (e.g., 232, FIG. 2) which can assist in free movement of the bottom rail in the third channel 1312. According to one embodiment, the third channel 1312 can include housing structures 1334. In one example, housing structures 1334 are constructed and arranged to include bristles at 1336 which also can be configured to maintain the position of a bottom rail within the third channel 1312 during operation of a curtain assembly. In one alternative, housing structures 1334 can be constructed and arranged with felt strips at 1336 instead of bristles. Other compressible materials can also be employed at 1336 to guide and control movement of the bottom rail during operation of a curtain assembly. In some implementations housing structures 1334 and bristles 1336 can be omitted.

According to some embodiments, track guide 1308 further defines a fourth channel 1314. The fourth channel 1314 is constructed and arranged to provide greater structural integrity to track guide. In some embodiments, track guide 1308 can be fabricated from aluminum and various structures can be constructed, e.g., fourth channel 1314, to provide for a desired strength for track guide 1308. In some embodiments, the fourth channel can be omitted. In other embodiments different materials can be used to mold, cast, and/or extrude a track guide and a fourth channel 1314 can be included as necessary to establish a desired strength for the track guide 1308. In one example, the track guide 1308 can be constructed of steel. In another example, the track guide 1308 can be constructed of plastic.

Track assembly 1300 mates with teeth 1302 of a zipper edge, in particular, teeth 1302 are configured to mate with a track insert 1304. Track insert 1304 defines a channel 1306 in which a portion of the curtain or a portion of a zipper edge and teeth 1302 may move freely during transitions between opened and closed positions of a curtain. The teeth 1302 and the channel 1306 are constructed and arranged to prevent the curtain from coming free of the track insert 1304. The material selected and the dimensions of track assembly 1300 can vary depending upon a given installation site. Materials can be selected based on aesthetic as well as based on structural considerations.

FIG. 13, shown is an example track assembly for multiple curtains which includes a second track guide portion 1350. Portion 1350 defines a channel 1352 configured to house a cellular fabric curtain. Cellular fabric curtain 1353 includes a plurality of stiffener inserts 1356. The stiffener inserts are constructed to provide rigidity to the cellular fabric curtain. Stiffener inserts 1356 are connected to guide portions 1358. Guide portions are constructed to mate with guide channel 1360. Guide portions 1358 move freely in channel 1360 during operation of the cellular fabric curtain 1354 between open and closed positions. Shown in FIG. 13 is one track assembly for multiple curtains. A second track assembly mirroring the first is used in conventional installations.

Figure 14B:
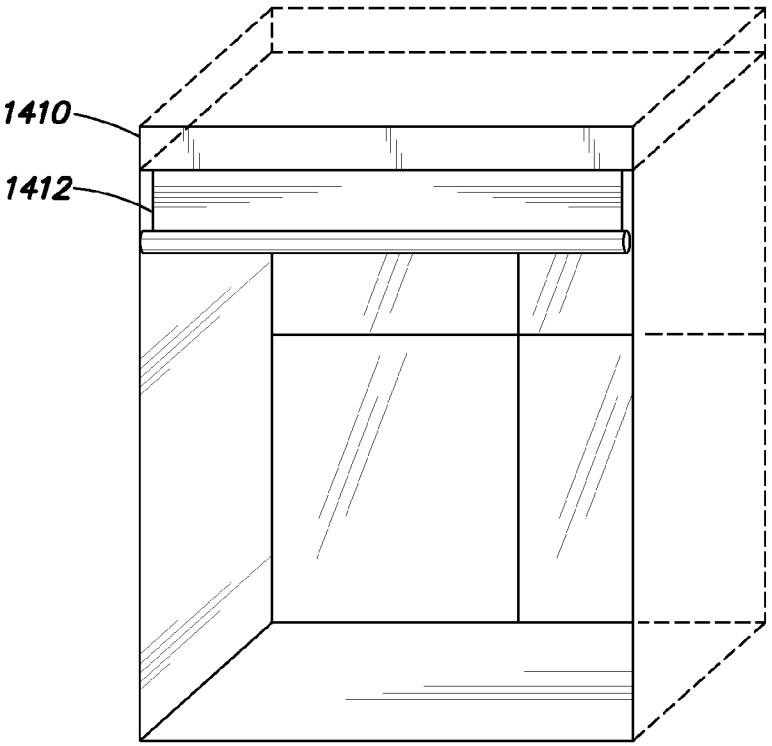
FIGS. 14A-C illustrate example window frames and element of curtain assemblies, according to some embodiments.
Figure 14A:
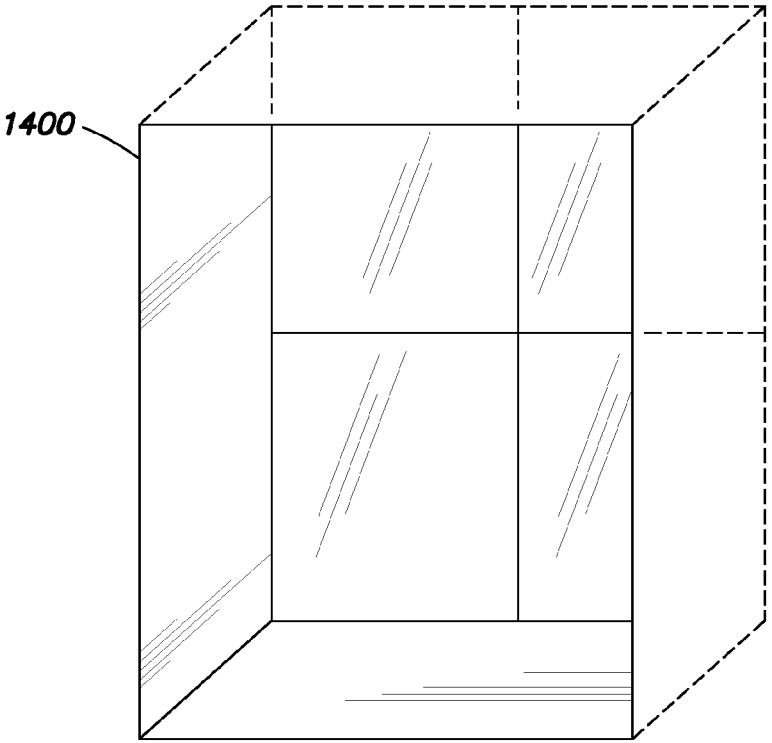

According to another aspect, a curtain assembly is provided. According to one embodiment, the curtain assembly is configured to fit within the space defined in a window box of a conventional interior window. The window box defines the interior portion of the space in which a window is installed. Typically a window is recessed into a wall so as to be flush or near to flush with the exterior surface of a building in which it is installed, shown for example in FIG. 14A, 1400. In some embodiments, the curtain assembly can include a head box configured to be installed within the recessed portion of the window box frame. In one example, a head box extends horizontally across the width of the window box frame, shown for example, in FIG. 14B at 1410. Further the head box 1410 can be attached to the top of the frame to support a curtain assembly and curtains (e.g., 1412. In other embodiments, the head box can be configured to install horizontally above the window box.

Figure 14C:
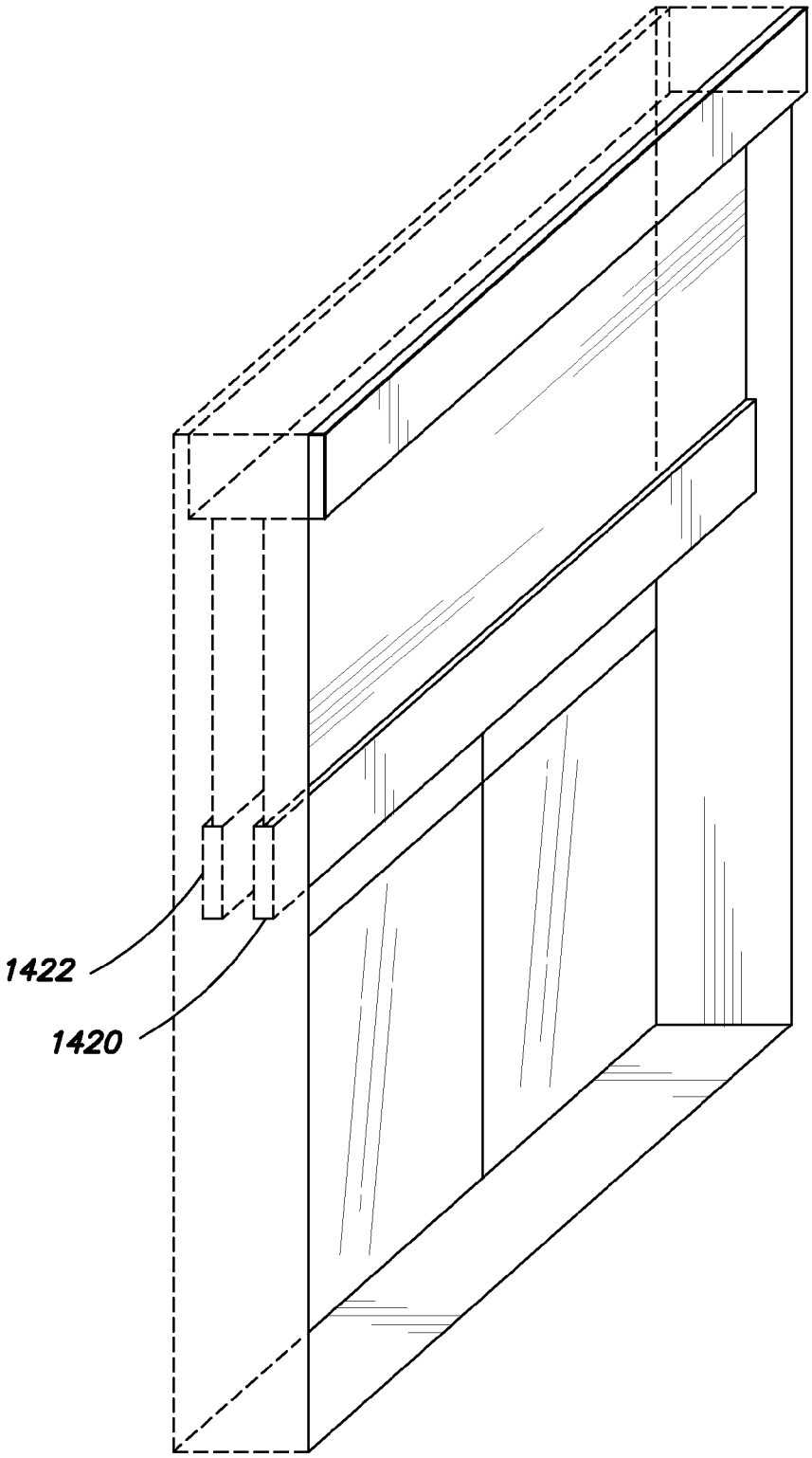

The curtain assembly can be constructed and arranged to open and close paired curtains to cover a window, shown for example in FIG. 14C. The paired curtains (e.g., 1420 and 1422) of the curtain assembly can be configured to define an air pocket between the paired curtains that improves the energy characteristics of the curtain assembly. Further in some embodiments, a curtain assembly having paired curtains can be configured specifically for noise reduction. In some paired curtain constructions, the interior facing curtain or front facing curtain 1420 can be selected based on aesthetic or design and the exterior facing or rear facing curtain 1422 can be constructed and arranged for specific energy properties.

In some embodiments, the curtain assembly can be constructed and arranged to include a sound absorbing curtain. In one example the sound absorbing curtain is a fabric curtain. In some embodiments, the sound absorbing is installed in the rear curtain position. The sound absorbing fabric can be configured in conjunction with the air pocket defined between the paired curtains to provide improved noise reduction capability. In other embodiments, both curtains can be configured of sound absorbing material to further increase the noise reduction capability. In some embodiments, the paired curtains are attached to a single roller in the head box (discussed in greater detail below). The single roller can be operatively connected to a motor, permitting automatic raising and lowering of the paired curtains. The single roller can also be configured to operate manually to raise and lower the paired curtains.

In other embodiments, the curtain assembly can be constructed and arranged to include an energy efficient curtain. In one example, the energy efficient curtain can be a fabric curtain configured to reduce energy transferred through any window. The energy efficient curtain can be configured to reduce energy loss and/or heat gain. In some embodiments, conventional fabrics can be installed having a low energy coating, a silver lining, and known insulation properties, among other examples. The paired curtains can be configured to establish an air pocket between the curtains. The air pocket is configured to increase the energy efficiency of the curtain assembly. In some embodiments, the paired curtains are attached to a single roller in the head box. The single roller can be operated manually and/or can be motorized to raise and lower the curtains into position over a window.

Figure 15:
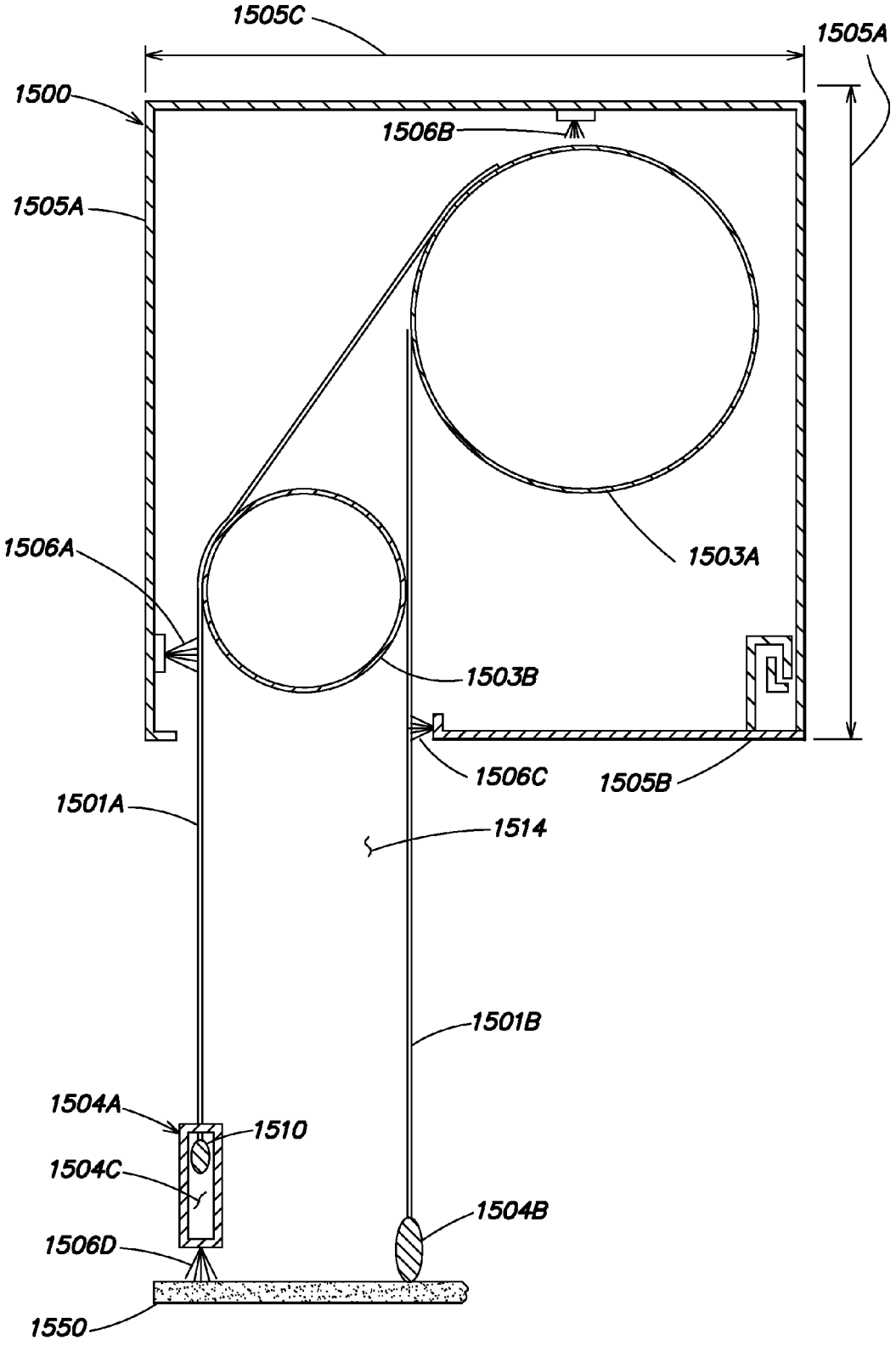
FIG. 15 illustrates structures for an example curtain assembly, according to one embodiment.

Shown in FIG. 15 is an example of a head box 1500 and associated structures for a curtain assembly. In one embodiment, head box 1500 is constructed and arranged to include a pair of curtains wound around a single roller 1503A. FIG. 15 illustrates a side view of an example head box 1500. Head box 1500 is constructed and arranged to house a single roll tube 1503A and other curtain assembly structures. Roll tube 1503A is configured to wind and unwind at least one curtain, for example, 1501B to position the curtain 1501B at or between an open and a closed position. In one embodiment, curtain 1501B can be a fabric curtain. In one example, curtain 1501B is constructed of a flat fabric panel or a substantially flat fabric panel.

Curtain 1501B can be constructed of a variety of materials. In some examples the construction material can depend on a desired energy value for the curtain assembly and/or a noise reduction capability desired. A second curtain 1501A can also be wound around roll tube 1503A housed in the head box 1500. The second curtain 1501A can be a different type of curtain than the curtain 1501A. The second curtain 1501B is arranged to face the interior of, for example, a dwelling in which the curtain assembly is installed.

In some embodiments, the second curtain is positioned towards the opening to be covered (e.g., the window) by an installed curtain assembly. The curtain 1501B can be positioned to conceal the second curtain 1501A when viewed from an interior location. For example, the curtain assembly can be positioned to cover an exterior window and the second curtain 1501A can be positioned closest to the window (a rear position), with the curtain 1501B covering the second curtain (a front position) from an interior perspective.

The second curtain can be selected based on its energy properties, including for example, a desired R value, or noise reduction capability. In some examples, this allows the curtain 1501B to be selected based on aesthetic properties. According to some embodiments, the second curtain 1501A is constructed of a low e coated fabric. Low-e coated fabric is configured to have a low energy emission ratio. Low e fabric can be constructed with metallic materials or materials having semi-conductive properties. In some examples, a fabric curtain can include a silver lining configured to improve the energy characteristics of the curtain and/or the curtain assembly. In some examples, other insulated fabric curtains can be employed. Low energy emissions curtains can be configured to limit heat and/or cold loss depending upon the environment in which the curtain assembly is installed.

The second curtain 1501A can be constructed and arranged to create an air pocket 1514 between the curtain 1501B and the second curtain 1501A. In some implementations, the air pocket improves the R value for the curtain assembly. In some embodiments, the air pocket is employed for improving noise level reduction capability of the separate curtains that make up the curtain assembly.

Roller Guide 1503B can be installed within the head box 1500 to position the second curtain 1501A closer to the opening to be covered. Further, in some embodiments roller guide 1503B can be positioned within the head box 1500 to provide the spacing between curtain 1501A and 1501B that defines a portion of air pocket 1514. In one example, roller guide 1503B is constructed having a 1.5" diameter. In some embodiments, different roller guides having different diameters can be installed in head box 1500 to define different sized air pockets 1514. Further the diameter of the roller guide is constructed to place curtain 1501A closer to any opening covered by a curtain assembly, and to position curtain 1501B towards the interior side of the covered opening.

In one example, the dimensions of head box at 1505A and C are constructed to fit within a variety of window frames. In one example, the head box 1500 is constructed having a height of 5.5" at 1505A and depth 1505C of 5". Other dimensions for the height and depth of head box can be constructed according to the dimensions of window and/or window box in which the head box is installed. According to some embodiments, head box 1500 can be constructed with a closure cap 1505B configured to conceal the interior structures of head box 1500, including roll tube 1503A and roller guide 1503B from an interior side viewing position.

According to some embodiments, brush seals 1506A, B, and C are positioned within the head box 1500 and mated with curtain 1501A and second curtain 1501B to improve the air pocket defined at 1514. Brush seals 1506A, B, and C maintain contact with curtain 1501A and 1501B during operation of the curtain assembly between open and closed positions. Brush seals 1506A, B, and C resist air flow into and out of air pocket 1514. In some embodiments, brush seals 1506A, B, and C improve the integrity of air pocket 1514 increasing the R value of the curtain assembly. In other embodiments, the increased integrity of air pocket 1514 improves the noise reducing properties of the curtain assembly. In some embodiments, brush seals 1506A, B, and C can be constructed of bristles, a fabric strip, or a resilient and compressible material.

In some embodiments, a bottom rail 1504B can be attached to curtain 1501B. The bottom rail 1504B can be weighted to assist in the operation of the curtain 1501B between an open and closed position. Curtain 1501A can also be attached to bottom rail 1504A. The bottom rail 1504A can be configured with a channel 1504C configured to allow for a difference in operating length of curtains 1501A and 1501B. As curtains 1501A and B transition between an open and closed position the difference in positioning of curtains 1501A and 1501B can result in differences in operating length. Channel 1504C in bottom rail 1504A is constructed and arranged to allow for variation in the lengths of curtains 1501A and 1501B during operation. In some embodiments, bottom rail 1504A is constructed to allow curtain 1501B to slide into channel 1504C. In one example, bottom rail 1504A is constructed and arranged with a 1" channel, providing for an operating length difference of up to 1". Curtain 1501A is connected to bar 1510. Bar 1510 is constructed with a diameter that allows bar 1510 to move within channel 1504C but mate with an upper portion of bottom rail 1504A upon lift of the curtain 1501A.

In some embodiments, when curtain 1501A is raised bar 1510 meets with an upper portion of bottom rail 1504A. Once bar 1510 meets with an upper portion of the bottom rail, both are lifted during continued lift of the curtain. When curtain 1501A is lowered, bottom rail 1504A meets with a portion of the window frame 1550 in which head box 1500 is installed. Once bottom rail 1504A contacts the portion of window frame 1550 continued lowering of curtain 1501A allows bar 1510 to descend within channel 1504C. The spacing provided by channel 1504C enables curtains 1501A and 1501B to have different operating lengths, while maintaining a seal with between curtains 1501A and 1501B and the portion of the window frame 1550. In some embodiments, bottom bar 1504C can include a brush seal 1506D to improve the connection between bottom rail 1504C and the portion of the window frame at 1550. In some embodiments, a bottom rail 1504B can be attached to curtain 1501B. The bottom rail 1504B can be weighted to assist in the operation of curtain 1501B. Unwinding curtains 1501A and 1501B can be assisted by gravity. Increasing the weight of the bottom rails 1504A and 1504B can increase the force applied to unwind curtains 1501A-B during operation of a curtain assembly. Bottom rail 1504B can also include a brush seal (not shown).

The side boundaries for the air pocket 1514 are not shown in FIG. 15. In some embodiments, the side boundaries for the air pocket 1514 occur at guide tracks mated to curtains 1501B and 1501A. For example, a tracked curtain assembly is shown in FIG. 1, where a curtain is held in place using a zippered edge portion that operates within a track insert held within a track guide—shown by way of example in FIG. 2. Curtain 1501B and the second curtain 1501A can operate within respective tracks, and the connection between the curtains and the tracks establish the side boundaries for the air pocket 1514.

Figure 16A:
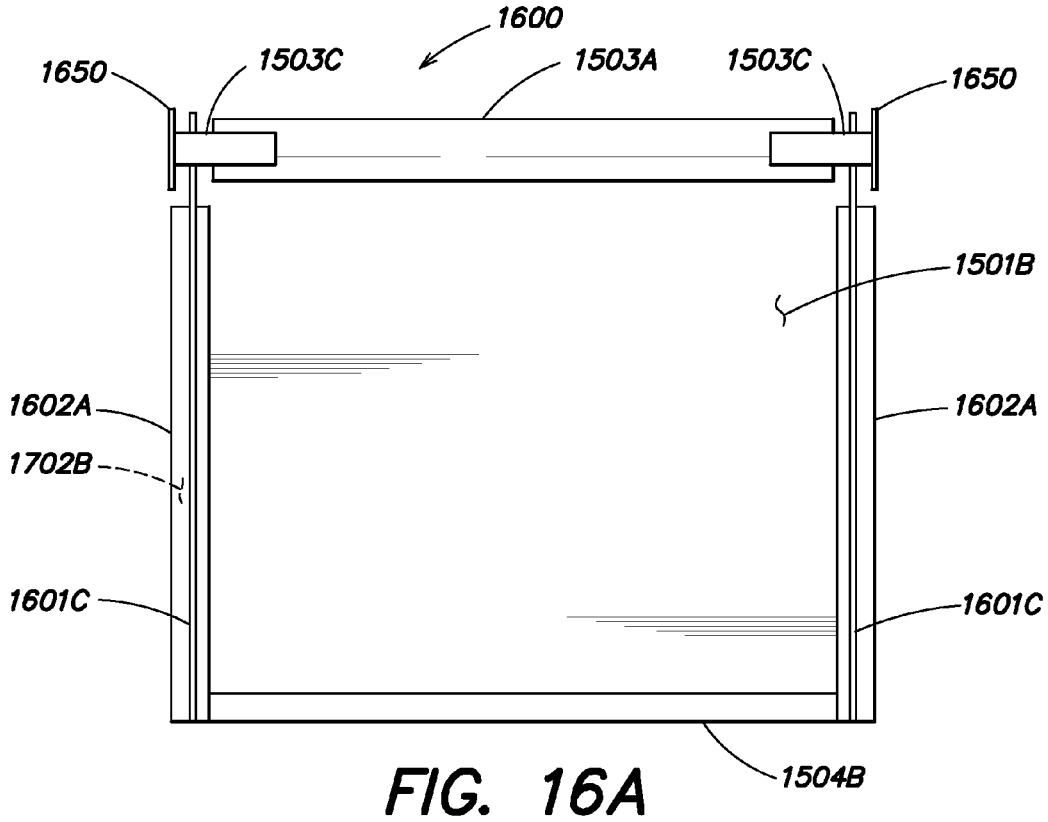
FIGS. 16A-B illustrate frontal views of example curtain assemblies, according to some embodiments.
Figure 16B:
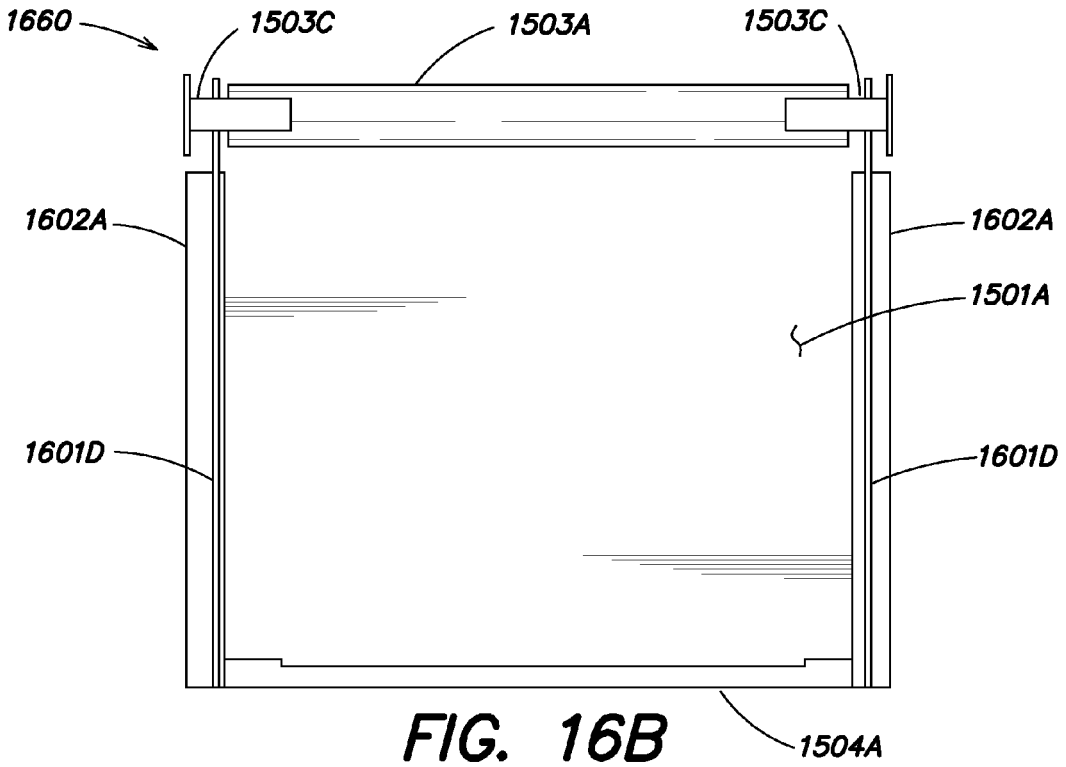

Shown in FIGS. 16A and 16B are example frontal views of a curtain assembly and internal structures of a head box of a curtain assembly. Frontal view 1600 illustrates a front view of curtain 1501B, roll tube 1503A, and bottom bar 1504B of FIG. 15. In some embodiments, curtain 1501B includes zipper edges 1601C that are configured to mate with structures defined by a tack insert (not shown) within track guides 1602A. Zipper edges 1601C are configured to permit curtain 1501B to move vertically within track guide 1602A while preventing horizontal movement of curtain 1501B. During operation of roll tube 1503A curtain 1501B is held taught across a covered opening due to attachment within track guides 1602A. Paired track guides 1602 installed on both sides of the curtain provide for a lateral force to be exerted on curtain 1501B while permitting the curtain and zipper edges to move up and down in channels defined in track guides 1602A. Paired zipper edges 1601C hold curtain 1501B in place by moveably mating to track guides 1602A within a channel 1711B (FIG. 17) defined by a track insert 1702B on either side of curtain 1501B. In some embodiments, track guides 1602A are separately mated to a window frame on both sides of the frame in which a curtain assembly and/or head box is installed.

In some embodiments, mounting brackets 1650 attach to a window frame to support a head box (not shown) in which roll tube 1503A is installed. In some embodiments, offset portions 1503C of roll tube 1503A can be mated directly to mounting brackets 1650. In other embodiments, roll tube 1503A and offset portions 1503C can be mated to structures within a head box, and the head box can be mated to mounting brackets 1650. Roll tube 1503A can be constructed with an offset portion both or either end of roll tube 1503A at 1503C. The offset portions 1503C are configured to provide addition space for the width of zipper edges 1601C of curtain 1501B. Offset portions 1503C are constructed with diameter less than the diameter of the roll tube 1503A. The spacing provided by the different diameter of offset portions can be dependent on the dimensions of the opening covered by curtain assembly. For example, the greater the height of the opening the longer the curtain and corresponding zipper edges. In some examples, the greater the length of the zipper edges the larger the volume of space the zipper edges will occupy when wound around roll tube 1503A. The greater volume occupied by zipper edges can be accommodated by increasing the length of the offset portions or reducing the diameter of the offset portion. In some embodiments, offset portion is constructed with a length of two inches. In some further embodiments, the diameter of the offset portion is to constructed to be one half inch less than the diameter of the roll tube 1503A.

As curtains 1501B (FIG. 16A) and 1501A (FIG. 16B) are wound around roll tube 1503A the width of the zipper edges 1601C-D is accommodated in offset portion 1503C. In some embodiments, the width of curtain 1501A and zipper edges 1601D (FIG. 16B) is constructed to have a width less than the width of curtain 1501B and zipper edges 1601C (FIG. 16A). In other embodiments, width of curtain 1501A and zipper edges 1601D (FIG. 16B) is constructed to have a width greater than the width of curtain 1501B and zipper edges 1601C (FIG. 16A). The difference in width between the curtains permits the zipper edges of the respective curtains to be wound around roll tube 1503A in the offset portions 1503C with reduced overlap. In some examples, a two inch offset is constructed on both sides of roll tube 1503A, although in other embodiments larger offset distances are constructed to accommodate longer curtains.

Returning to FIG. 16A, zipper edges 1601C are configured to operate within a channel of track guide 1602A. Zipper edges 1601C are mated to the edges of curtain 1501B. The curtain 1501B and zipper edges are configured so that the zipper edges mate with a channel of the track guide preventing horizontal movement of the curtain within track guides 1602A, but permitting vertical movement of the curtain 1501B within track guides 1602A (i.e. for raising and lowering of curtain 1501B in response to rotation of roll tube 1503A).

Figure 17:
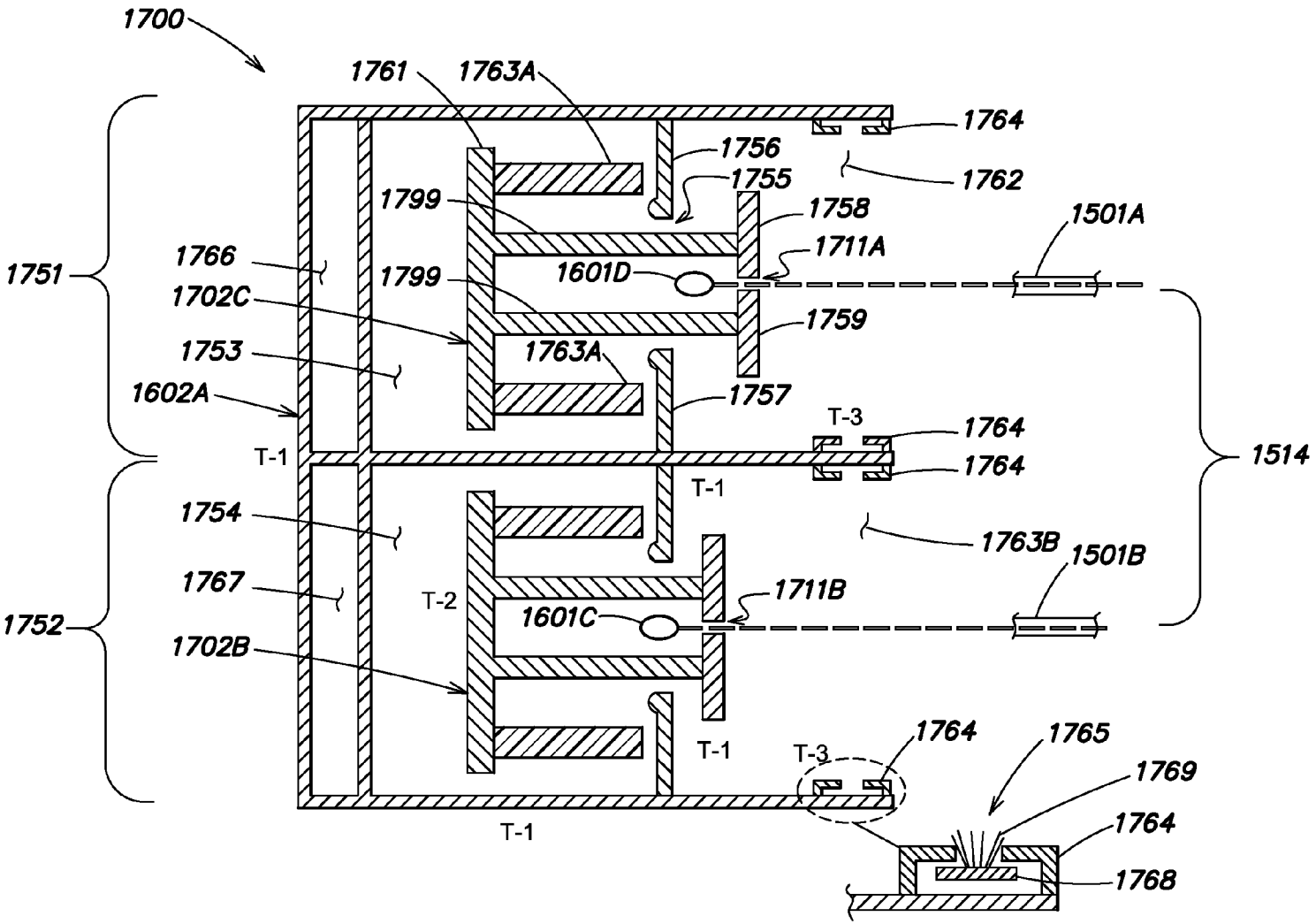
FIG. 17 illustrates a view of one side of an example track guide, according to one embodiment.

Track guides 1602A define channels for both curtains 1501B and 1501A (one side of an example track showing a view of both channels is illustrated in FIG. 17, discussed in greater detail below).

Frontal view 1660 FIG. 16B illustrates a front view of curtain 1501A, roll tube 1503A, bottom bar 1504A of FIG. 15. In some embodiments, curtain 1501A includes zipper edges 1601D that are configured to mate with structures (e.g., 1711A FIG. 17) in track guides 1602A. Zipper edges 1601C are configured to permit curtain 1501B to move vertically within track guide 1602A while holding curtain 1501A in position by exerting horizontal force on curtain 1501B. Paired zipper edges 1601D hold curtain 1501A in place by mating to track guides 1602A. In some embodiments, track guides 1602A are mated to a window frame in which a curtain assembly and/or head box is installed.

In some embodiments, mounting brackets 1650 attach to a window frame to support a head box (not shown) in which roll tube 1503A is installed. In some embodiments, offset portions 1503C can be mated directly to mounting brackets 1650. In other embodiments, roll tube 1503A and offset portions 1503C can be mated to structures within a head box, and the head box can be mated to mounting brackets 1650. Roll tube 1503A is constructed with an offset portion on either or both ends at 1503C. The offset portions 1503C are configured to provide addition space for the width of zipper edges 1601C of curtain 1501A as curtain 1501A is wound around roll tube 1503A. In some embodiments, curtain 1501B can also include zippered edge, and offset portions can be configured to accept the width of zipper edges from both curtains. Offset portions 1503C can be configured to accept the additional width of any zipper edges on curtains 1501A and 1501B.

Zipper edges 1601D are configured to operate within a channel of track guide 1602A. Zipper edges 1601C are mated to the edges of curtain 1501B so that the zipper edges mate with the channel of track guide preventing horizontal movement of the curtain within track guides 1602A, but permitting vertical movement of the curtain 1501B within track guides 1602A (i.e. raising and lowering of curtain 1501B in response to rotation of roll tube 1503A).

Shown in FIG. 17 is a view of one side of an example track guide 1700. Track guide 1700 is constructed with two curtain channel portions 1751 and 1752 in which curtains 1501A and 1501B slide during operation of roll tube 1503A. According to some embodiments, track guide 1700 includes track inserts 1702C and 1702B in respective channel portions 1751 and 1752. Curtains 1501A and 1501B mate with respective track inserts 1702C and 1702B to hold the curtains in position for an installed curtain assembly. Curtains 1501A-B are mated with track inserts at channels 1711A-B which prevent lateral movement of the curtains while permitting the curtains to slide up and down in channels 1711A-B. A width of zipper edge 1601C of curtain 1501B exceeds the width of the channel 1711B, preventing curtain 1501B from coming out of track insert 1702B and track guide 1602A. The width of respective curtains 1501A-B is less than the width of respective channels 1711A-B permitting the curtains to slide freely through channels 1711A-B when moving up and down in the respective channels.

In some embodiments, each of the curtain channel portions can be constructed and arranged as discussed above with respect to FIG. 2. In other embodiments, curtain channel portions can exclude features discussed above with respect to FIG. 2, for example, wheel assembly 232. In other embodiments, each of the curtain channel portions can be constructed and arranged as discussed above with respect to FIG. 13 and track guide portion 1308. In still other embodiments, channel positions can be constructed and arranged as discussed above with respect to FIGS. 13 and 1350, however, the cellular fabric curtain would not be employed, rather, the curtain would be constructed of a flat or substantially flat fabric panel.

Figure 18:
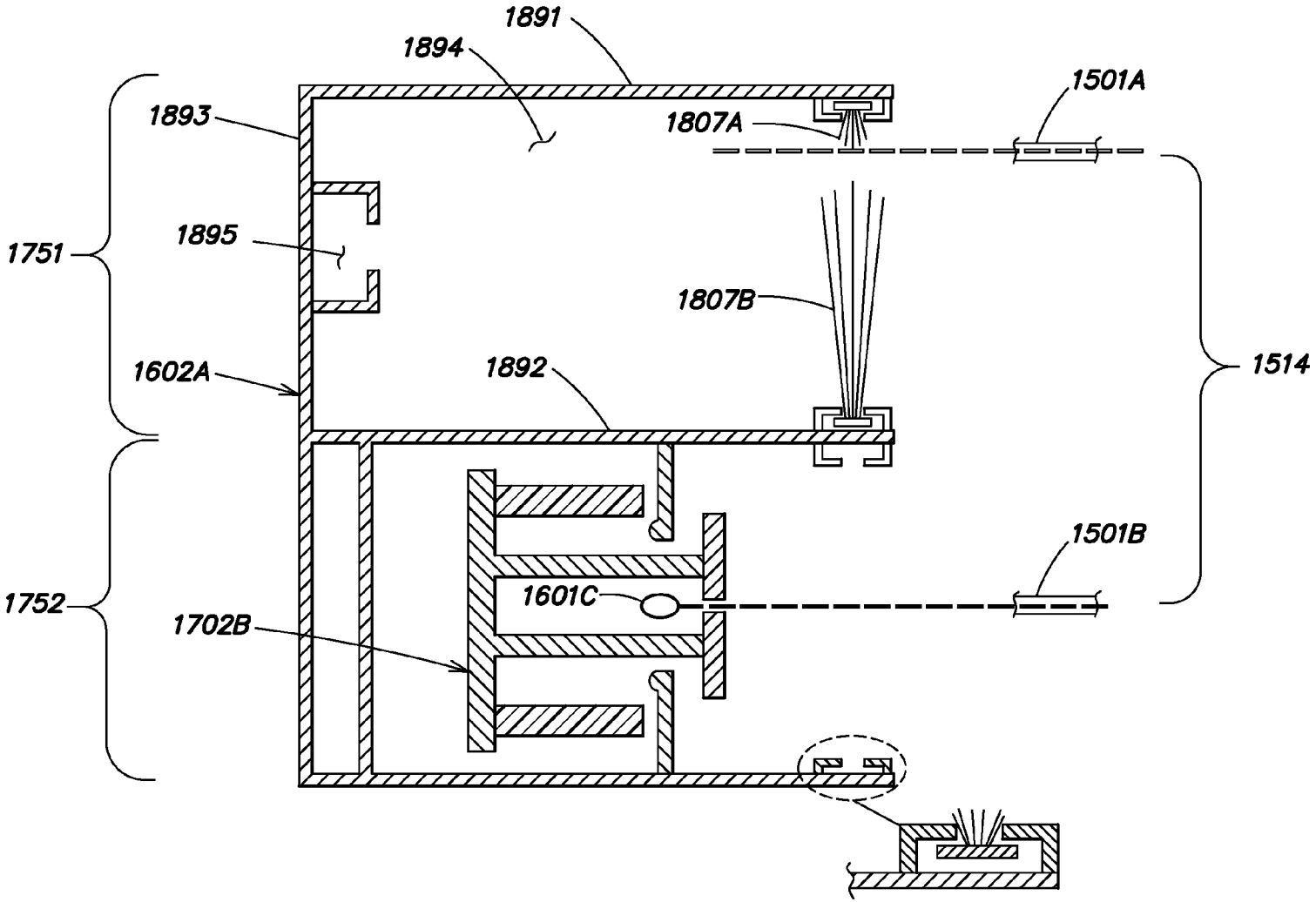
FIG. 18 illustrates a view of one side of an example track guide, according to one embodiment.

In some alternatives, each of the curtain channel portions 1751 and 1752 can be constructed and arranged as discussed in any of FIG. 2, FIG. 13 at 1308 or 1350. Additional embodiments of curtain channel portions 1751 and 1752 are illustrated in FIG. 18. FIG. 18 shows a view of an example track guide 1602A. In other embodiments, both channel portions can be constructed and arranged as shown at 1751 of FIG. 18. Channel portion 1751 can be configured to mate with curtains including zipper edges or not, and further the positions of 1751 and 1752 illustrated in FIG. 18 can be constructed with their positions reversed.

In some embodiments, track inserts 1702B and 1702C can be constructed and arranged as discussed above with respect to FIG. 2 and track insert 204. In some embodiments, the width of track insert 1702C (measured left to right) can exceed the width of track insert 1702B (measured left to right). In one alternative (not shown) width of track insert 1702C can be less than that of track insert 1702B. The difference in width of the track inserts 1702C and 1702B is configured to permit zipper edges 1601C and 1601D to be wound around a roll tube with minimal overlap between the two zipper edges.

Returning to FIG. 17, track guide 1602A defines a first channel 1753 constructed and arranged to house a portion of track insert 1702C. Track insert 1702C is moveably coupled to track guide 1602A. Track insert 1702C extends the length of guide track 1602, however, compressible portions 1763 provide for some motion in track insert 1702C, when for example, a force is applied to curtain 1501A.

A portion of track insert 1702C is positioned within the first channel 1753 and at least a portion of a yoke 1799 of the track insert 1702C is positioned within a channel opening 1755. The exterior edges of opening 1755 are defined by a first 1756 and second flange 1757 of the track guide 1602A. Track insert 1702C includes a first 1758 and second cap 1759 portion that are constructed to hold the track insert 1702C in the first channel 1753 and channel opening 1755. The first 1758 and second 1759 cap portions operate in conjunction with a base portion 1761 of the track insert 1702C to hold the track insert in place. In some embodiments, the track insert 1702C can include compressible portions at 1763.

In some examples, the compressible portions 1763 can be constructed of felt, sponge material, rubber, bristles or other compressible material. The compressible portions 1763 can be configured to permit small side to side movements of track insert 1702C in the channel opening 1755. According to some embodiments, the capability of side to side movement assists in the operation of the curtain assembly. During periods of increased pressure on the curtain compressible portions 1763 can be compressed relieving tension in the curtain and insuring the curtain does not become bound in place during operation. In some embodiments, compressible portions 1763 are constructed of sound deadening sponges.

When curtains 1501A-B are operated between open and closed positions or anywhere in between the portion of the curtains and/or the portion of the respective zipper edges will move freely up and down in channels defined in respective track inserts (e.g., at 1711A and 1711B). Additionally, a bottom rail of the respective curtains (not shown) can also be configured to move freely within a third channel (e.g., 1762 and 1763) defined by the track guide 1602A.

According to one embodiment, the channel 1762 can include housing structures 1764. In one example, housing structures 1764 are constructed and arranged to include bristles at 1765 which also can be configured to maintain the position of respective bottom rails 1504A-B within the respective channels 1762 and 1763 during operation of a curtain assembly. In one alternative, housing structures 1764 can be constructed and arranged with felt strips at 1765 instead of bristles. Other compressible materials can also be employed at 1765 to guide and control movement, for example, of the respective bottom rails 1504A-B during operation of a curtain assembly. In some implementations housing structures 1764 and bristles 1765 can be omitted. In one example, 1765 includes a base 1768 that can be pressure fit and/or glued into position. Bristles 1769 extend from the base at 1768 and are configured to contact curtain structures within for example, channel 1762.

According to some embodiments, track guide 1602A further defines another channel at 1766 and 1767 for each respective channel portion 1751 and 1752. The channels 1766 and 1767 are constructed and arranged to provide increased structural integrity to track guide 1602A. In some embodiments, track guide 1602A can be fabricated from aluminum and various structures can be constructed, e.g., channels 1766 and 1767, to provide for a desired strength for track guide 1602A. In some embodiments, the channels 1766 and 1767 can be omitted. In other embodiments different materials can be used to mold, cast, and/or extrude a track guide, and channels 1766 and 1767 can be included as necessary to establish a desired strength for the track guide 1602A. In one example, the track guide 1602A can be constructed of steel. In another example, the track guide 1602A can be constructed of plastic. In yet another, exterior portions of track guide 1602A can be composed of aluminum and the interior track inserts can be constructed of plastic.

The material selected and the dimensions of track guide 1602A can vary depending upon a given installation site. Materials can be selected based on aesthetic as well as based on structural considerations. In one example, the dimensions of the track guide can be as follows: Portion 1751 and 1752 respective widths (measured top to bottom of illustration) of 1.44 inches, channel 1753 and 1754 can be 1.255 inches wide (measured top to bottom of illustration), channel 1755 can be 0.525 inches wide (measured top to bottom of illustrates section), the interior of channel 1753 can be 0.67 inches long (measured left to right of illustration), the spacing between housing structures 1764 of respective channel portions 1751 and 1752 can be 1.10 inches, the interior of channel 1762 (measured from interior edge to opening left to right) can be 0.67 inches long, 1766 and 1767 can be 0.47 inches long (from left edge to interior right side), to provide some examples. In one embodiment, the exterior portions of track guide 1602A are constructed of aluminum having thickness at each portion indicated by references T-1, T-2 of 0.06 inches and indicated by T-3 of 0.04 inches. In other embodiments, different dimension can be employed. Further, different materials used to construct the track guide 1602A can require different dimensions and/or permit smaller installation dimensions. In some embodiments, dimensions of the opening to be covered by the curtain assembly can dictate the dimensions of the head box and internal structures described. For purposes of clarity not all structures in FIG. 17 have been explicitly referenced, for example, where the structures are the same or substantially similar to other described structures, in particular, some of the structures mirrored between channel portion 1751 and 1752 have not been explicitly referenced.

FIG. 18 shows a view of an example of one side track guide 1602A. Track guide 1602A includes channel portions 1751 and 1752. Some of the differences between the embodiments illustrated in FIG. 17 and FIG. 18 are directed to the channel portion 1751 and related structures. For purposes of clarity, only channel portion 1751 is described in greater detail. Channel portion 1751 is constructed of exterior frame portions 1891, 1893, and interior frame portion 1893. Frame portions 1891-1893 define an interior channel 1894. Curtain 1501A can be positioned within channel 1894 during operation of the curtain assembly. Curtain 1501A can be held in operating position by brushes 1807A and 1807B. The pressure exerted by brushes 1807A-B holds curtain 1501A in channel 1894 during operation of the curtain assembly, including raising and lowering of the curtains 1501A-B.

In some embodiments, curtain 1501A can include stiffener elements (not shown) to assist in providing rigidity to fabric curtain 1501A. Stiffener elements can be attached to curtain 1501A and extend laterally across the curtain. In some embodiments, the stiffener elements can be mated to channel 1895 to provide additional support and to hold curtain 1501A in place during operation. In particular, stiffener elements can move freely up and down in channel 1895 with curtain 1501A is raised or lowered into portion. In some embodiments, a bottom rail 1504B be mated with channel 1895. Bottom rail 1504B can also be constructed to mate with channel 1895. In some examples, bottom rail 1504B is configured to move freely up and down in channel 1895 while preventing curtain 1501A from moving laterally. In some embodiments, bottom rail 1504B is weighted to assist in operation of curtain 1501A. In particular, the weight of bottom rail 1504B can assist lowering of curtain 1501A by operation of gravity. The weight of bottom rail 1504B can also be configured to provide tension within fabric curtain 1501A.

One should appreciate that the present invention is not limited in its application to the details of construction and the arrangement of components set forth in the foregoing description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A curtain assembly comprising:

at least a first and second curtain selectably moveable between an open position and a closed position;

a track guide having a first and second opposed sides, wherein the first and second sides define a plane of operation for the first curtain as it moves between the open position and the closed position, wherein the first and second sides of the track guide each include an open channel with a first and second internal flange within the track guide and extending laterally and partially into the open channel;

a first and second track insert coupled to the opposed sides of the track guide at the first and second internal flange of the open channel, the first and second track inserts each disposed partially within respective open channels of the first and second sides of the track guide and extending through a space defined by the first and second internal flange at respective sides of the track guide, wherein the first curtain is moveably coupled to the first and second track inserts, each of the first and second track inserts having a cross-section structure, wherein the cross-section defines a base member, connected to a first yoke terminating in a first horizontal structure and the base member connected to a second yoke terminating in a second horizontal structure, wherein the first and second horizontal structures extend towards each other with a spacing separating the first and second horizontal structures, wherein the spacing defines a channel of operation at which the respective track insert and the first curtain are moveably coupled, and wherein the first curtain travels along the open channel of operation within the first and second track insert during transition between the open and the closed position; and an air barrier defined between at least the at least first and second curtains constructed and arranged to improve energy properties of the curtain assembly, wherein the air barrier is defined at least by the first and second curtains.

2. The curtain assembly of claim 1, further comprising a brush portion constructed and arranged to bridge a spacing between the first and second curtains, wherein the brush portion is constructed and arranged to further define at least one boundary of the air barrier.

3. The curtain assembly of claim 1, wherein a first compressible portion engages a first end of the base member and the first internal flange, and a second compressible portion engages a second end of the base member and the second internal flange.

4. The curtain assembly of claim 1, further comprising a brush portion constructed and arranged to seal a top portion of the air barrier.

5. The curtain assembly of claim 4, wherein the brush portion is constructed and arranged to traverse the width of the first and second curtains.

6. The curtain assembly of claim 1, further comprising a base member connecting the first and second curtains.

7. The curtain assembly of claim 6, wherein the base member is constructed and arranged to connect bottom portions of the first and second curtains.

8. The curtain assembly of claim 6, wherein the base member is constructed and arranged to define a bottom boundary of the air barrier.

9. The curtain assembly of claim 6, wherein the base member is constructed and arranged to traverse the width of the first and second curtains.

10. The curtain assembly of claim 1, wherein the second curtain is constructed and arranged of a cellular fabric.

11. The curtain assembly of claim 10, wherein the first curtain has an energy value substantially less that the second curtain.

12. The curtain assembly of claim 10, further comprising at least one stiffener guide constructed and arranged to strengthen the cellular fabric.

13. The curtain assembly of claim 10, further comprising a second track guide having a first and second side, wherein the first and second side define a plane of operation for the second curtain as it moves between the open position and the closed position.

14. The curtain assembly of claim 13, wherein the first and second sides, which define a plane of operation for the second curtain, and include respective channel guides.

15. The curtain assembly of claim 14, further comprising at least one stiffener guide positioned within the cellular fabric, wherein the at least one stiffener guide is constructed and arranged to ride within the respective channel guides during operation of the curtain assembly.

16. The curtain assembly of claim 1, further comprising a first roll tube, wherein the first roll tube is constructed and arranged to wind the first and second curtains around the roll tube during operation of the curtain assembly, wherein the first and second curtains are connected to the roll tube in overlapping positions.

17. The curtain assembly of claim 16, further comprising a second track guide having a first and second side, wherein the first and second side define a plane of operation for the second curtain as it moves between the open position and the closed position; a third and fourth track insert coupled to opposed sides of the second track guide, wherein the second curtain is moveably coupled to the third and fourth track inserts, wherein the third and fourth track inserts each define a respective channel of operation at which the track insert and the second curtain are moveably coupled, and wherein the second curtain travels along the channel of operation during transition between the open and the closed position.

18. The curtain assembly of claim 16, further comprising a roller guide constructed and arranged to maintain a spacing between the first and second curtains.

19. The curtain assembly of claim 18, further comprising an air barrier defined between the first and second curtains and the roller guide constructed and arranged to improve energy shielding properties of the curtain assembly.

20. The curtain assembly of claim 16, further comprising a bottom rail connected to at least one of the first and second curtains.

21. The curtain assembly of claim 20, wherein the bottom rail includes a length adjustment channel.

22. The curtain assembly of claim 21, wherein the at least one of the first and second curtains is connected to a bar within the bottom rail, wherein the bar is constructed and arranged to travel within the adjustment channel.

23. The curtain assembly of claim 22, wherein the bar is weighted to pull excess length of a connected curtain into the adjustment channel.

24. A curtain assembly comprising:

at least a first and a second curtain selectably moveable between an open position and a closed position;

a roll tube constructed and arranged to wind to the first and second curtains around the roll tube during operation of the curtain assembly, wherein the first and second curtains are mated to the roll tube in overlapping positions;

a cylindrical roller guide having the first curtain in pressurized contact with a first part of the cylindrical roller guide and the second curtain in pressurized contact with a second part of the cylindrical roller guide, the cylindrical roller guide constructed and arranged to maintain a spacing between the first and second curtains during operation;

a track guide having a first and second opposed sides, wherein the first and second sides of the track guide each include an open channel with a first and second internal flange extending laterally and partially into the open channel;

a first and second track insert coupled to the opposed sides of the track guide at the first and second internal flange of the open channel, the first and second track inserts each disposed partially within respective open channels of the first and second sides of the track guide and extending through a space defined by the first and second internal flange at respective sides of the track guide, wherein the first curtain is moveably coupled to the first and second track inserts, wherein the first and second track inserts each define a respective opening that is a channel of operation at which the track insert and the curtain are moveably coupled, and wherein the curtain travels along the open channel of operation within the first and second track insert during transition between the open and the closed position; and an air barrier defined between the first and second curtains constructed and arranged to improve energy properties of the curtain assembly.

25. The curtain assembly of claim 24, further comprising at least one brush portion constructed and arranged to improve an air seal at a top portion of the air barrier.

26. The curtain assembly of claim 25, wherein the at least one brush portion is constructed and arranged to traverse the width of a spacing between the first and second curtains.

27. The curtain assembly of claim 24, further comprising a bottom rail connected to at least one of the first and second curtains.

28. The curtain assembly of claim 27, wherein the bottom rail includes a length adjustment channel.

29. The curtain assembly of claim 28, wherein the at least one of the first and second curtains is connected to a bar within the bottom rail, wherein the bar is constructed and arranged to travel within the adjustment channel.

30. The curtain assembly of claim 29, wherein the bar is weighted to pull excess length of a connected curtain into the adjustment channel.

* * * * *